US008826575B2

(12) United States Patent
Ufer et al.

(10) Patent No.: US 8,826,575 B2
(45) Date of Patent: Sep. 9, 2014

(54) SELF CALIBRATING WEAPON SHOT COUNTER

(76) Inventors: Robert Ufer, Punta Gorda, FL (US); Kenneth Lee Brinkley, Owenton, KY (US)

( * ) Notice: Subject to any disclaimer, the term of this patent is extended or adjusted under 35 U.S.C. 154(b) by 275 days.

(21) Appl. No.: 13/066,105

(22) Filed: Apr. 6, 2011

(65) Prior Publication Data

US 2011/0252684 A1 Oct. 20, 2011

Related U.S. Application Data

(63) Continuation-in-part of application No. 12/799,134, filed on Apr. 19, 2010, now abandoned, which is a continuation-in-part of application No. 12/380,375, filed on Feb. 26, 2009, now abandoned.

(60) Provisional application No. 61/067,294, filed on Feb. 27, 2008.

(51) Int. Cl.
*F41A 9/62* (2006.01)

(52) U.S. Cl.
USPC ..... 42/1.03; 42/1.01; 42/84

(58) Field of Classification Search
USPC ..... 42/1.03, 1.01, 84; 89/1.1
See application file for complete search history.

(56) References Cited

U.S. PATENT DOCUMENTS 5,072,389 A * 12/1991 Wernli et al. ..... 89/41.14
5,425,299 A * 6/1995 Teetzel ..... 89/14.4
5,566,486 A * 10/1996 Brinkley ..... 42/1.02
6,094,850 A * 8/2000 Villani ..... 42/1.02
6,434,875 B1 * 8/2002 Constant et al. ..... 42/84
6,561,071 B1 * 5/2003 Norton et al. ..... 89/1.1
6,564,687 B2 * 5/2003 Poole ..... 89/1.11
6,626,040 B1 * 9/2003 Pereira et al. ..... 73/514.38
7,180,019 B1 * 2/2007 Chiou et al. ..... 200/61.45 R
7,306,462 B2 * 12/2007 Metcalfe et al. ..... 434/18
7,509,766 B2 * 3/2009 Vasquez ..... 42/1.01
7,562,480 B2 * 7/2009 Mauch et al. ..... 42/70.01
7,600,339 B2 * 10/2009 Schumacher et al. ..... 42/70.01
7,669,356 B2 * 3/2010 Joannes et al. ..... 42/1.01
7,716,863 B1 * 5/2010 Johnson et al. ..... 42/1.02
7,802,391 B2 * 9/2010 Quinn et al. ..... 42/1.03
7,956,302 B1 * 6/2011 Jean et al. ..... 200/61.45 R
8,046,946 B2 * 11/2011 Packer et al. ..... 42/1.01
8,117,778 B2 * 2/2012 Clark et al. ..... 42/1.01
8,176,667 B2 * 5/2012 Kamal et al. ..... 42/1.01
8,215,044 B2 * 7/2012 Arbouw ..... 42/1.02
8,215,048 B2 * 7/2012 Summers ..... 42/85
8,312,660 B1 * 11/2012 Fujisaki ..... 42/70.11
8,353,121 B2 * 1/2013 Clark et al. ..... 42/1.01
2003/0061753 A1 * 4/2003 Glock ..... 42/1.02
2004/0121292 A1 * 6/2004 Chung et al. ..... 434/11

(Continued)

*Primary Examiner* — Michelle Clement
(74) *Attorney, Agent, or Firm* — Richard B Klar; Law Office Richard B Klar

(57) ABSTRACT

A microcontroller operated module is affixed to a firearm. The module includes an accelerometer for measuring the G force of each round fired by the firearm, a flash memory (non-volatile memory) for storing the shot profile data that includes shot count and recoil data and transmitting it to a remote location such as a remote computer via a serial communication device pursuant to RS232 standard, Bluetooth, a wave or other low power RF transmitter. The module including a wake up circuit adapted to switch upon detection of a fired shot to signal said microcontroller to initialize a low power mode to activate said MEMS accelerometer faster than said accelerometer would activate by itself.

33 Claims, 17 Drawing Sheets

(56) References Cited

U.S. PATENT DOCUMENTS

| | | | | |
|---|---|---|---|---|
| 2004/0200109 | A1* | 10/2004 | Vasquez | 42/1.01 |
| 2008/0000130 | A1* | 1/2008 | Mauch et al. | 42/70.11 |
| 2008/0016744 | A1* | 1/2008 | Joannes et al. | 42/1.01 |
| 2008/0061991 | A1* | 3/2008 | Urban et al. | 340/573.1 |
| 2008/0282595 | A1* | 11/2008 | Clark et al. | 42/1.01 |
| 2009/0211139 | A1* | 8/2009 | Ufer et al. | 42/1.03 |
| 2009/0255160 | A1* | 10/2009 | Summers | 42/70.01 |
| 2009/0277065 | A1* | 11/2009 | Clark et al. | 42/1.03 |
| 2010/0011943 | A1* | 1/2010 | Quinn et al. | 89/1.1 |
| 2010/0108478 | A1* | 5/2010 | Zhe et al. | 200/61.45 R |
| 2010/0139141 | A1* | 6/2010 | Pikielny | 42/1.03 |
| 2010/0223829 | A1* | 9/2010 | Ufer et al. | 42/1.03 |
| 2010/0281725 | A1* | 11/2010 | Arbouw | 42/1.02 |
| 2011/0067282 | A1* | 3/2011 | August et al. | 42/1.03 |
| 2011/0119979 | A1* | 5/2011 | Gussalli Beretta et al. | 42/1.02 |
| 2011/0126622 | A1* | 6/2011 | Turner | 73/514.01 |
| 2011/0162245 | A1* | 7/2011 | Kamal et al. | 42/1.01 |
| 2011/0252683 | A1* | 10/2011 | Chedid et al. | 42/1.03 |
| 2012/0000979 | A1* | 1/2012 | Horvath et al. | 235/407 |
| 2012/0117848 | A1* | 5/2012 | Cox et al. | 42/130 |
| 2012/0137870 | A1* | 6/2012 | Lindsay et al. | 89/191.01 |
| 2012/0144711 | A1* | 6/2012 | Glock | 42/1.03 |
| 2012/0167423 | A1* | 7/2012 | Kindt et al. | 42/1.02 |
| 2012/0192476 | A1* | 8/2012 | Compton et al. | 42/84 |
| 2012/0297654 | A1* | 11/2012 | Williams et al. | 42/1.01 |
| 2013/0061504 | A1* | 3/2013 | Malherbe et al. | 42/84 |
| 2013/0125438 | A1* | 5/2013 | Delgado Acarreta | 42/1.03 |

* cited by examiner

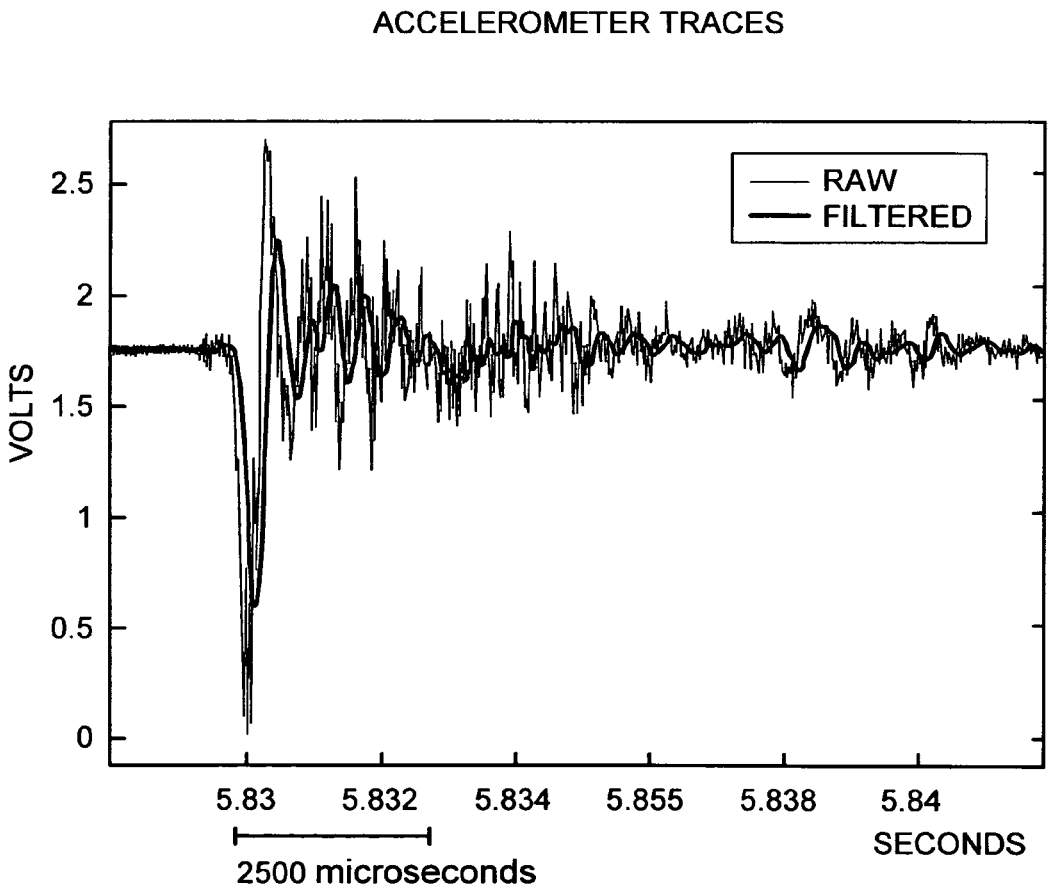
F I G. 10. Typical shot pulse for AR-15 weapon

STANDARD ACCELEROMETER

FAST-ACTING ACCELEROMETER

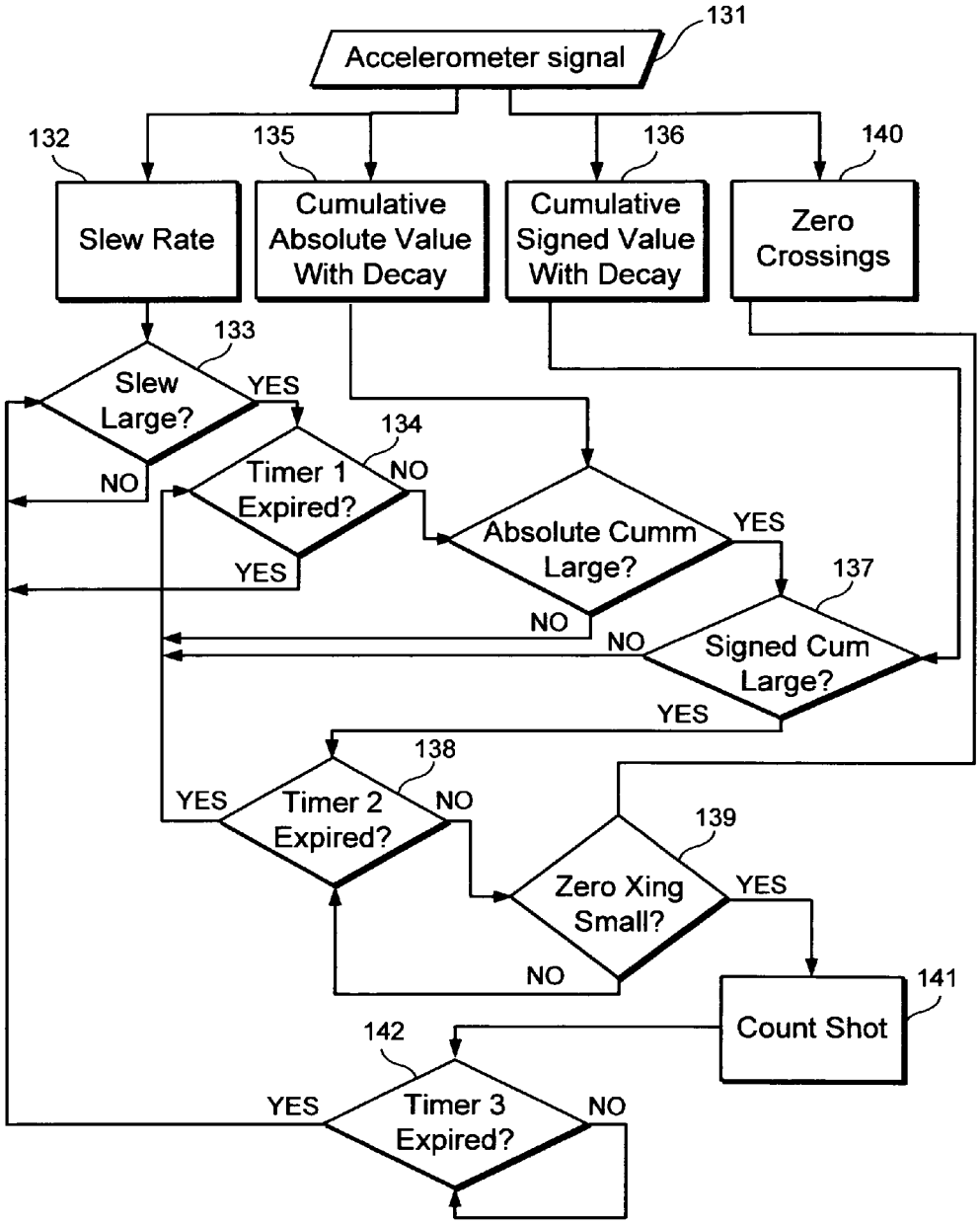
F I G. 12. Flow Chart of Shot Detection Algorithm

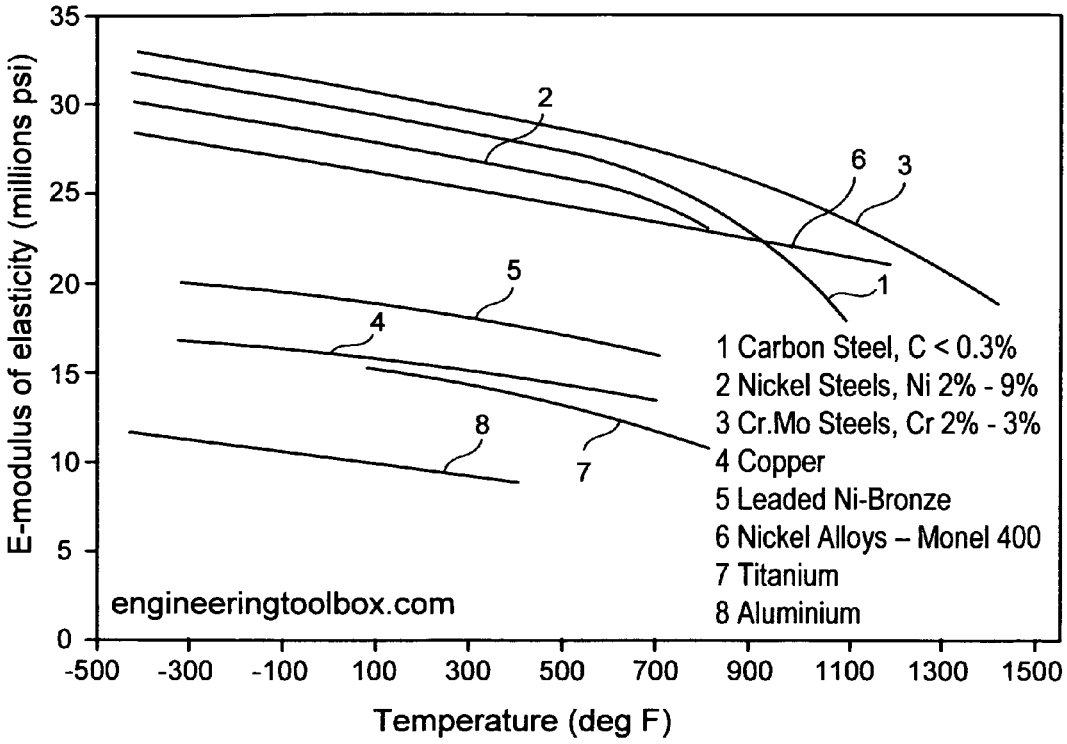
F I G. 13. Young's Modules versus temperature for various metals.

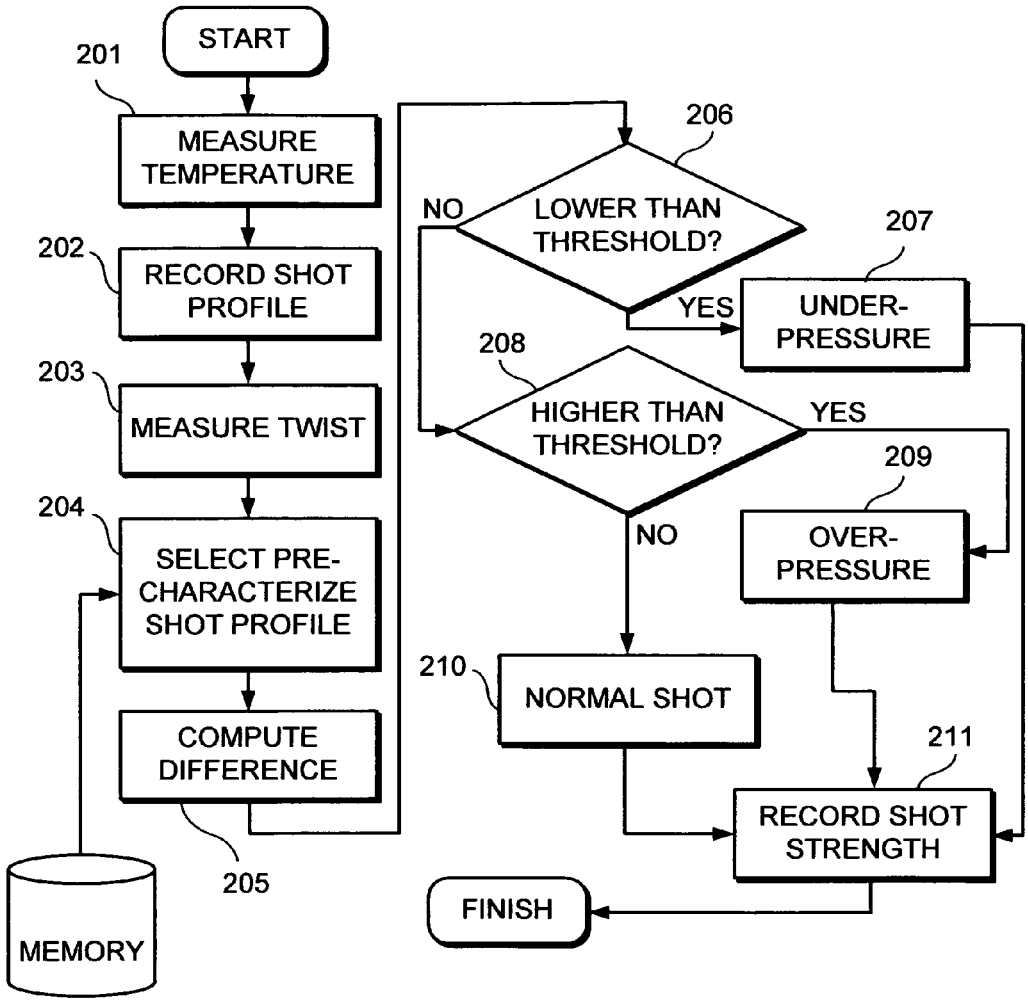
F I G. 14. Detection of over- or under-pressure event.

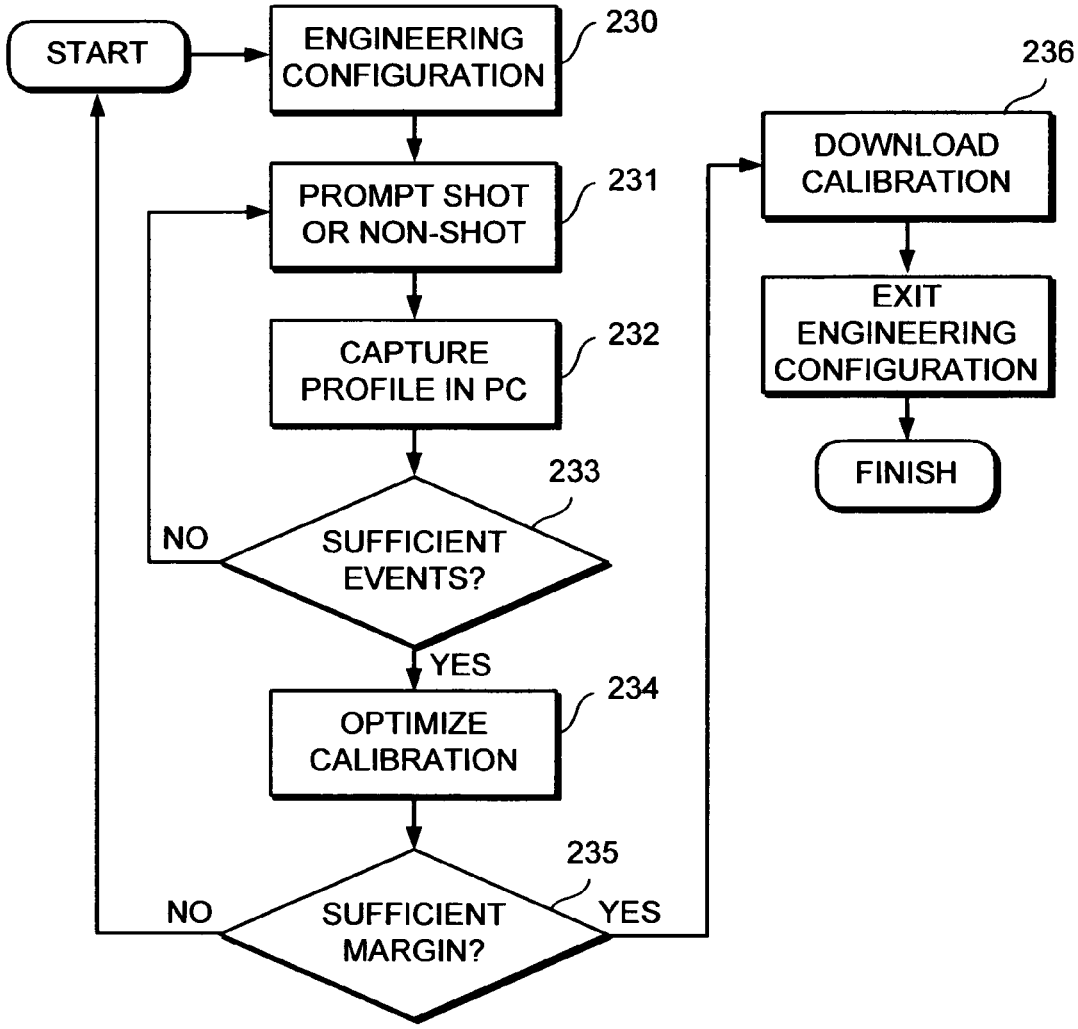
F I G. 15. Self-calibration procedure

SELF CALIBRATING WEAPON SHOT COUNTER

RELATED APPLICATIONS

This is a continuation in part application of U.S. application Ser. No. 12/799,134 filed on Apr. 19, 2010 now abandoned and claims priority thereof under 35 USC 120, which in turn is a continuation in part application of U.S. Ser. No. 12,380,375 filed on Feb. 26, 2009 now abandoned and claims priority under 35 USC 120 which in turn is nonprovisional application of a provisional application Ser. No. 61/067,294 filed on Feb. 27, 2008 and claims priority under 35 USC 119.

BACKGROUND

1. Field

The present disclosure relates to a self-calibrating weapon shot counter with a wake up circuit. The present disclosure provides for an apparatus and a method for counting the number of rounds fired through a weapon, storing it on board the shot counter and then conveying the shot count and related information to an external or remote device when prompted by an authorized user with a proper encryption key. In particular, the present disclosure relates to a self calibrating weapon shot counter that has a module operated by a microcontroller for collecting, storing and transmitting data to a computer, PDA or other electronic device, preferably remotely located from the firearm. The data collected and transmitted by the self calibrating weapons shot counter of the present disclosure includes, shot profile data, including recoil in both directions, rotational axis sensor data and duration of shot, identifying type of weapon, round fired, i.e. caliber and weight and barrel length. The time, date and profile of the shot fired is also recorded and transmitted to the remote computer. The present disclosure provides for an active RFID tag communication port that listens for, records the data and sends it to a remote location. The weapon shot counter of the present disclosure is capable of being interchanged from one weapon to another. The weapon shot counter can also be used as an ancillary munitions recognition system, i.e. hand grenades, high explosive, fragmentary, incendiary, chemical and smoke as well as, claymore mines utilized by same user as weapon counting device. In this type of use, the weapon shot counter of the present disclosure acts as a repeater gathering the data from the thrown hand grenades, upon spoon release the chip in the hand grenade is charged by an onboard generator that sends out the serial number to the weapon shot counter that in turn sends it on to the PDA, identifying the grenade or other munitions that has been used. In this way, the present disclosure provides for real time information as to munitions usage, which can be transmitted to support personnel allowing for timely resupply of munitions. This was previously unheard of as it is understood that no previous weapon shot counter discussed this feature or capability and is unique to the self-calibrating weapons shot counter of the present disclosure.

2. The Prior Art

U.S. Pat. No. 5,566,486 to Brinkley discloses a firearm monitor device for counting a number of rounds discharged.

US Patent Publication No. 2009/0016744 to Joannes et al. describes a wake-up circuit whose purpose is to conserve power when the weapon is idle. A normally-open ("N-O") switch is described (two, actually), which is used for the purpose of bringing the microprocessor from "sleep" mode to "active" or normal mode. An N-O switch has fundamentally inferior time performance characteristics compared to a normally closed ("N-C") switch.

SUMMARY

The present disclosure provides for a wake up circuit to resolve the problem of when an accelerometer does not wake up fast enough to capture the entire energy pulse, a common problem associated with off the shelf accelerometers. The wake up circuit can be a normally closed g switch (gravity switch) with a quicker response than that of the accelerometer 8 employed in the present disclosure. The g switch 80 also provides for power conservation due, as it is a mechanically triggered switch. The present disclosure provides for a convenient, reliable low power shot counter, which provides valuable data for timely servicing of both small and large arms. In addition, the present disclosure provides for position information and engineering data, as is needed. The shot counter of the present disclosure further provides for a repeater function for nearby or distant munitions to provide timely resupply thereof.

The apparatus and method of the present disclosure provides a self calibrating weapon shot counter capable of gathering shot data including, depending on configuration: (a) the full shot acceleration profile data along the weapon barrel axis; (b) angular rate about the barrel axis during a shot; (c) duration of the shot (related to barrel length); and (d) strength of the round (e.g. regular or plus powder charge as well as identifying underpowered loads). These data, in various combinations, can be sent via wired or wireless protocol to an external or remote device, in one of three modes of operation, switchable via two-way communications with the shot counter, namely: (i) on demand, in response to a prompt by a remote device; (ii) automatically after any and every shot; or (iii) supplying raw or compressed shot acceleration and angular rate data for engineering purposes. Within each of these communication modes, the shot counter may also provide any combination of data related to the weapon configuration or pre-stored history, such as: (1) weapon identification number; (2) round caliber; (3) barrel type; (4) time and date; (5) overpressure or under pressure; or (6) history log. The history log would be used to establish preventative maintenance alerts. Once established they would be able to estimate at what round count the weapon will fail and send an alert to the user. This allows for the replacement of parts prior to failure and may be used to identify what part may fail. Internal to the shot counter itself are one or more linear accelerometers, optionally an angular rate sensor, a microprocessor and non-volatile memory, and one or more of connectors for wired communications, a circuit for two-way wireless communication, and a transmitter and antenna circuit for one-way wireless communication. Internal to the microprocessor is one or more algorithms, including one which processes raw accelerometer and optionally angular rate data into a determination of whether a shot was fired, and the increment and non-volatile memory storage of the new cumulative shot count. Other algorithm functions may derive one or more of the above characteristics (b), (c), or (d), which may also be stored in non-volatile memory, and may be communicated as configured in one or more of modes (i), (ii), or (iii). Self calibration of the shot counter is performed while in two-way communication with a remote device, so that the calibration routine can be provided with identification of the type of ammunition, the type of weapon, the barrel type, the mounting location, software revisions and other configuration options, as well as environmental conditions (such as temperature and air pressure)

which may affect the shot acceleration and angular rate profiles. The user is instructed how to, and how many, rounds to fire in order to obtain a valid self calibration, and may optionally be given a signal indicating that the self calibration is within nominal error bounds. Through two-way communication, the data stored in the shot counter non-volatile memory can be accessed, optionally via a secure, encrypted, or password-protected means, and modified including, but not limited to, reset of the shot count, update, appending, or deleting of the history log, and the configuration or replacement of the firmware of the algorithm, self-calibration routine, or other functions. In the two-way communications mode, the shot counter may further be used as a repeater, or network hub, gathering wireless signals provided by other nearby munitions, and either relaying directly, or in a summarized form, this information to a remote device. The capabilities described herein are useful for a number of purposes, including, but not limited to: (I) detecting when the weapon is ready for servicing; (II) indicating when the barrel or any other part of the weapon needs to be replaced; (III) indicating that a shot has been fired, and, through a remote device, tagging this information with a location; (IV) providing inventory information within a depot, including weapon configuration (e.g. barrel length); (V) relaying munitions use and status within a local area to a remote device; (VI) calibrating the shot counter to a new weapon; (VII) providing a history log relative to a particular weapon; or (VIII) providing engineering data for characterization or analysis of weapon or shot counter performance.

The present disclosure relates to a microcontroller-operated module affixed to a firearm. The module includes a MEMS accelerometer for measuring the G force of each round fired by the firearm. The G force is measured simultaneously in two axes, in line with the recoil and in cross-rotational axis in both directions. The weapons shot counter of the present disclosure includes a flash memory (non-volatile memory) for storing the shot profile data that includes shot count and recoil data. The flash memory transmits the shot profile data to a remote location such as a remote computer via a serial communication device such as but not limited to an RFID device pursuant to RS232 standard, Bluetooth, awave or other low power RF transmitter.

The present disclosure provides for a wake up circuit adapted to switch upon detection of a fired shot to signal said microcontroller to initialize a low power mode to activate said MEMS accelerometer faster than said accelerometer would activate by itself. The wake up circuit can be configured as but is not limited to a normally closed g switch.

BRIEF DESCRIPTION

FIGS. 2A and 2B are operational software diagram of the microcontroller operation of the module of the present disclosure in which:

Figure 1:
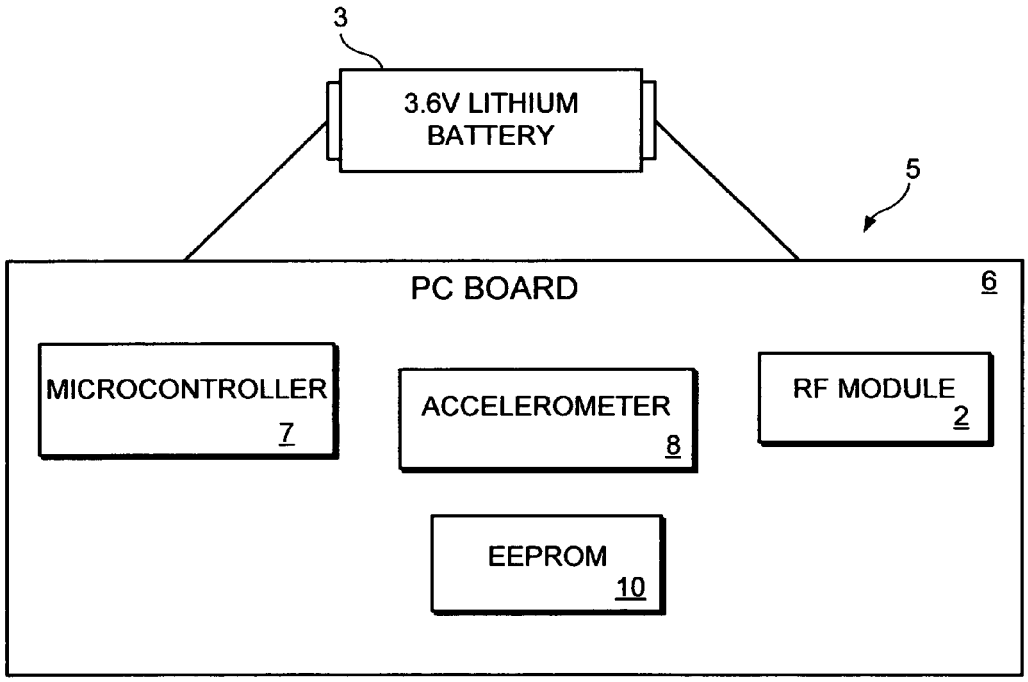
FIG. 1 is a block diagram of the circuitry of the module of the present disclosure.
Figure 2A:
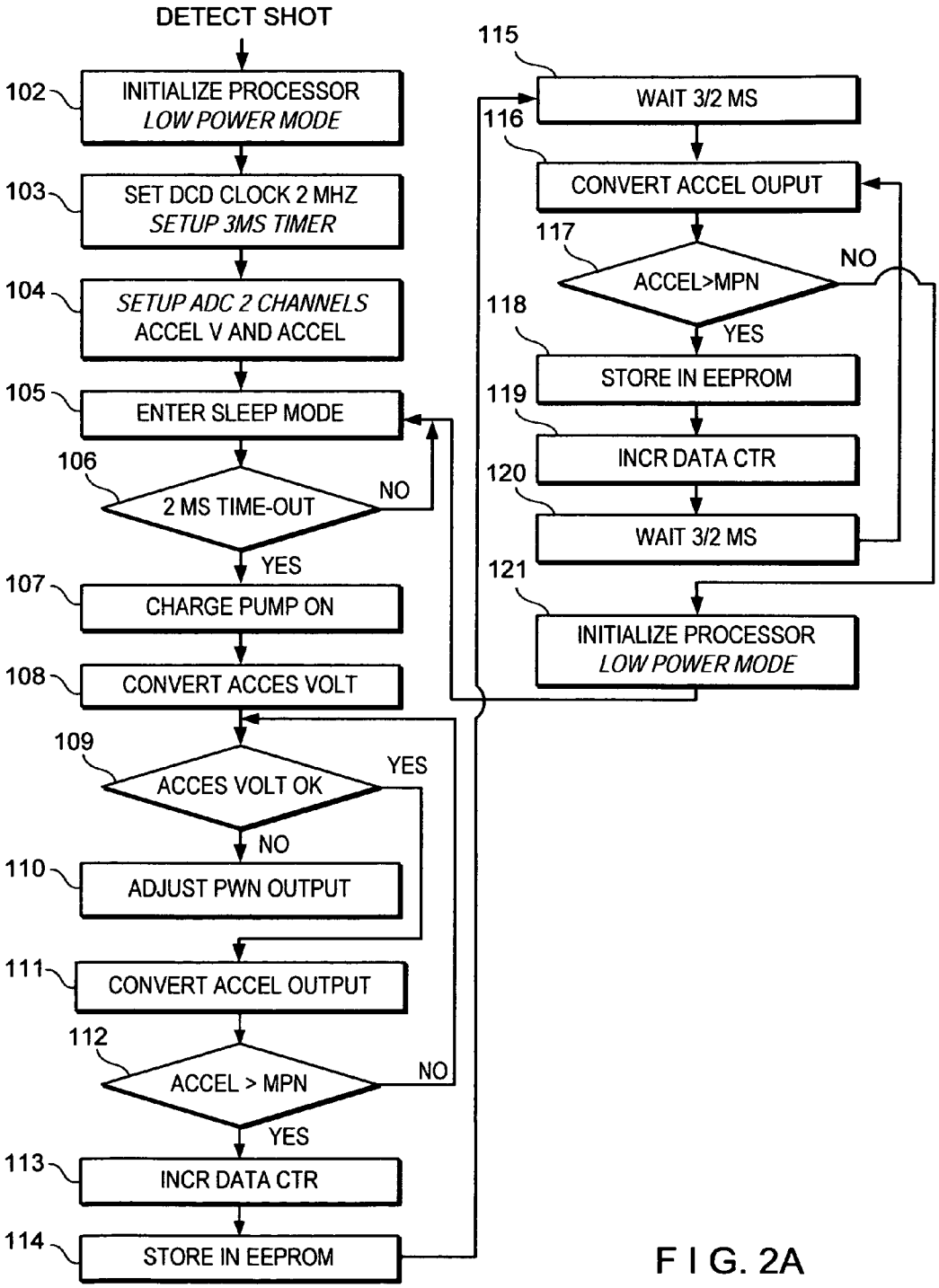
Figure 3B:
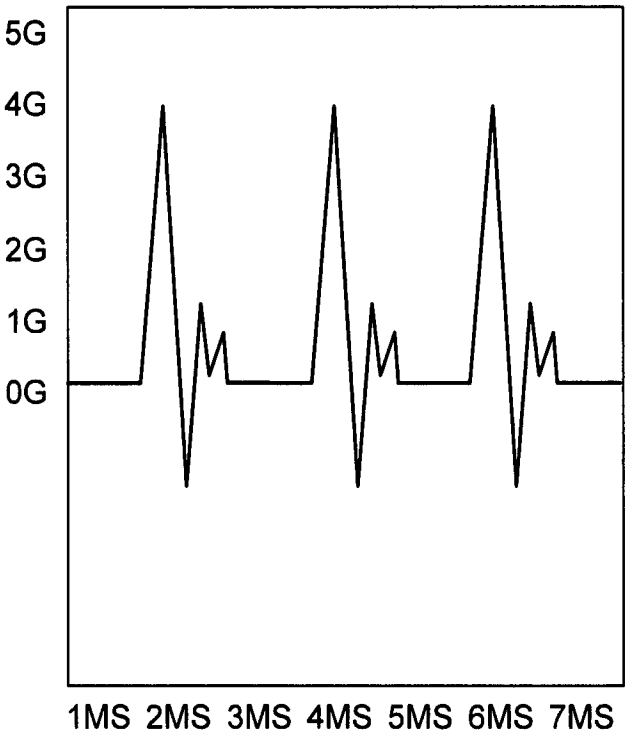
Figure 3A:
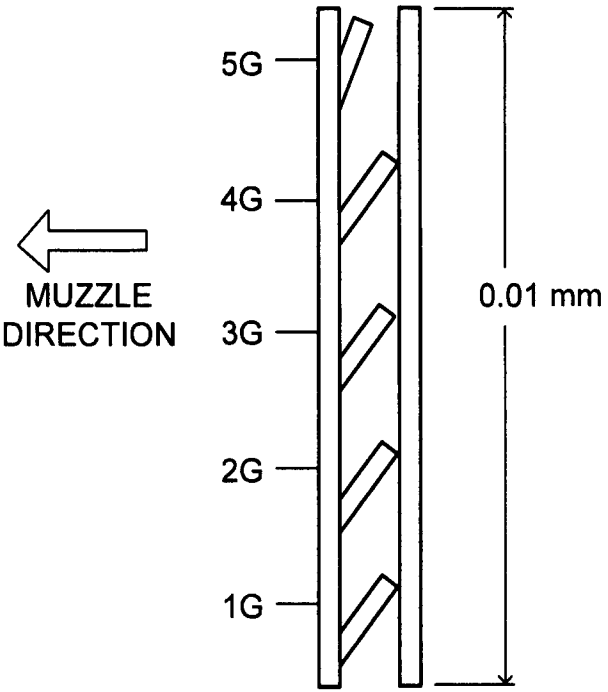
Figure 4:
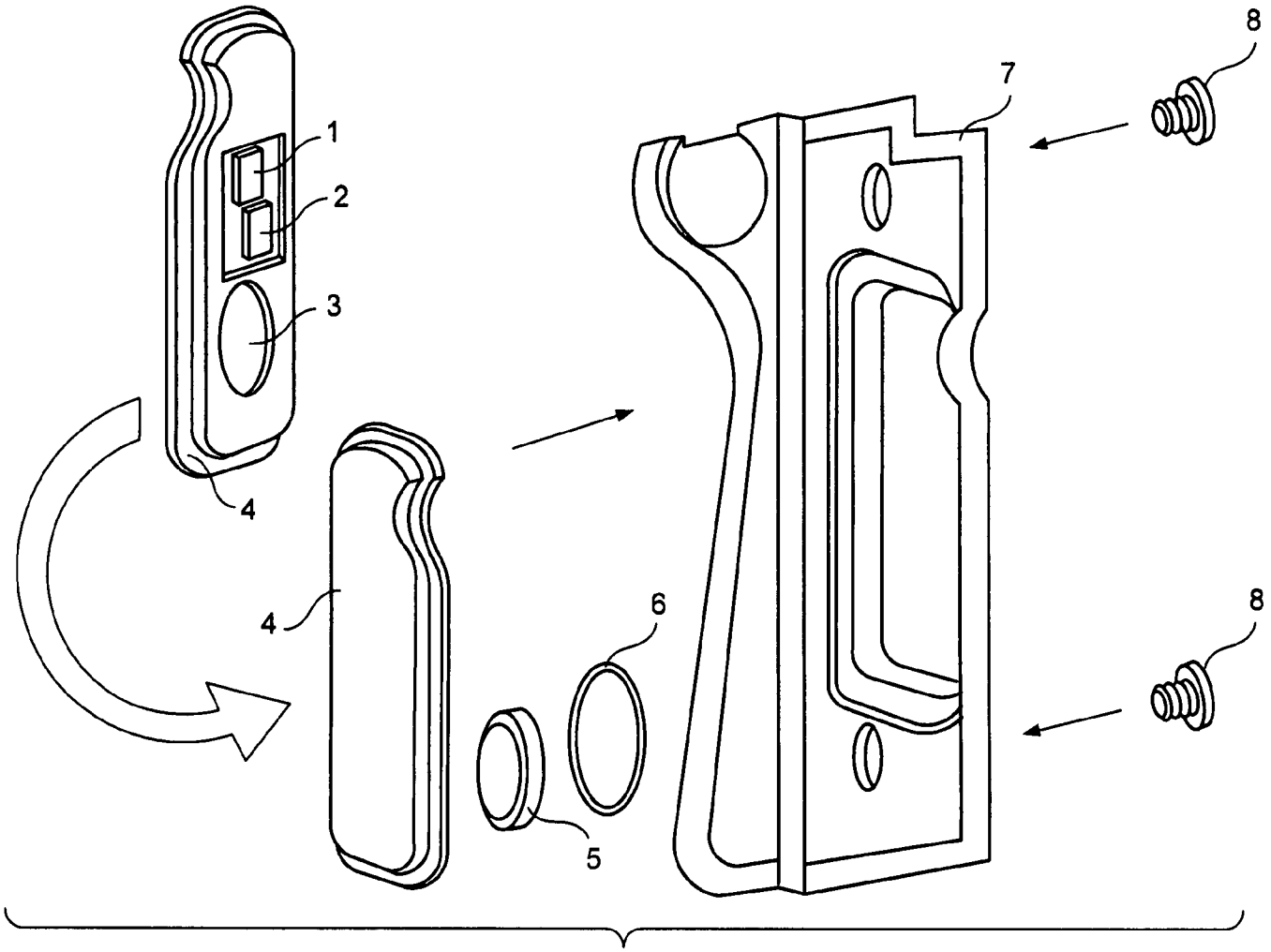
Figure 5:
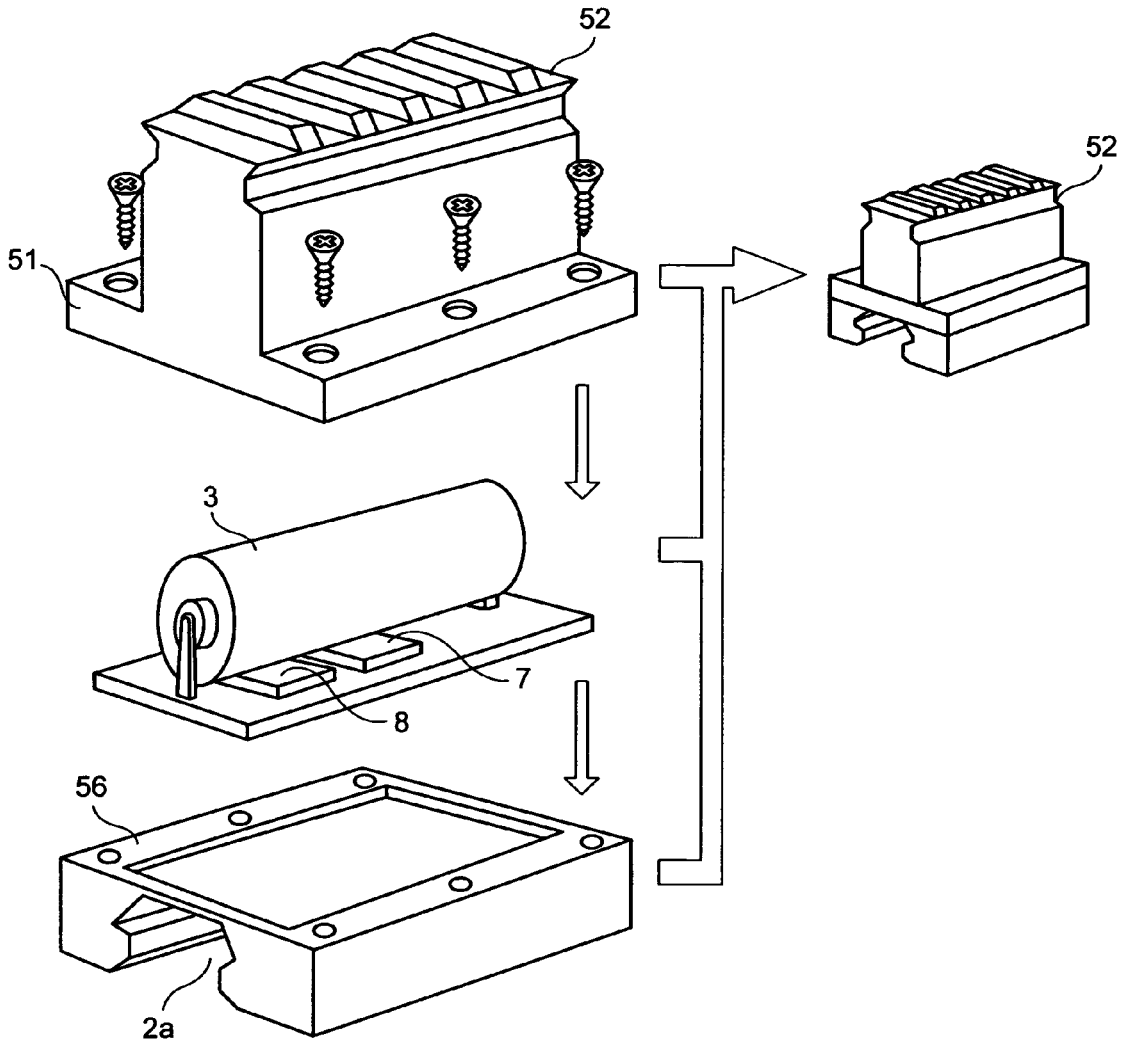
Figure 6:
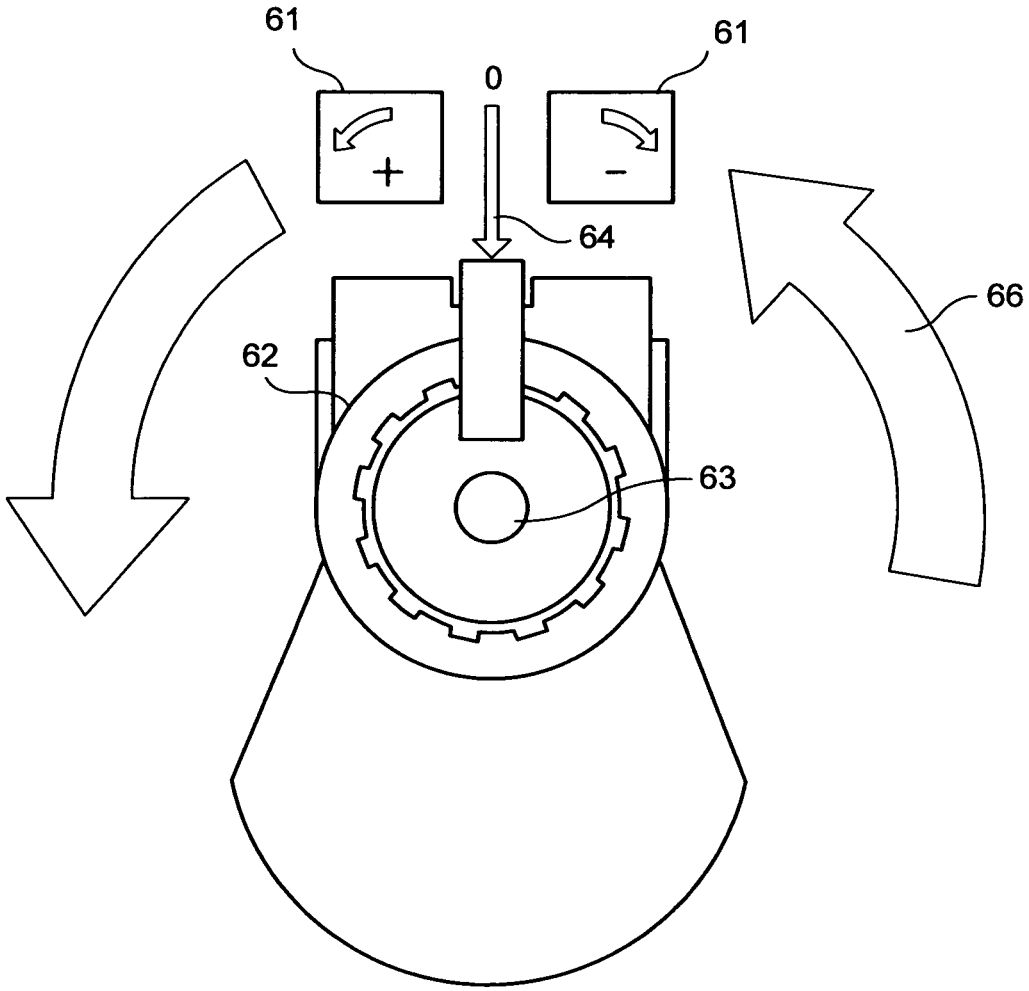
Figure 7:
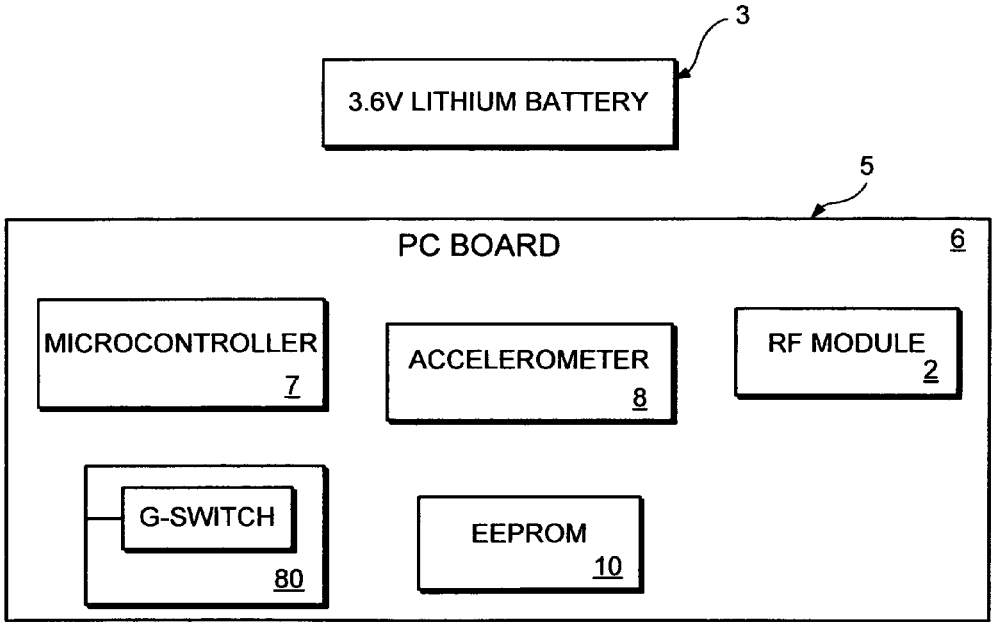
Figure 8A:
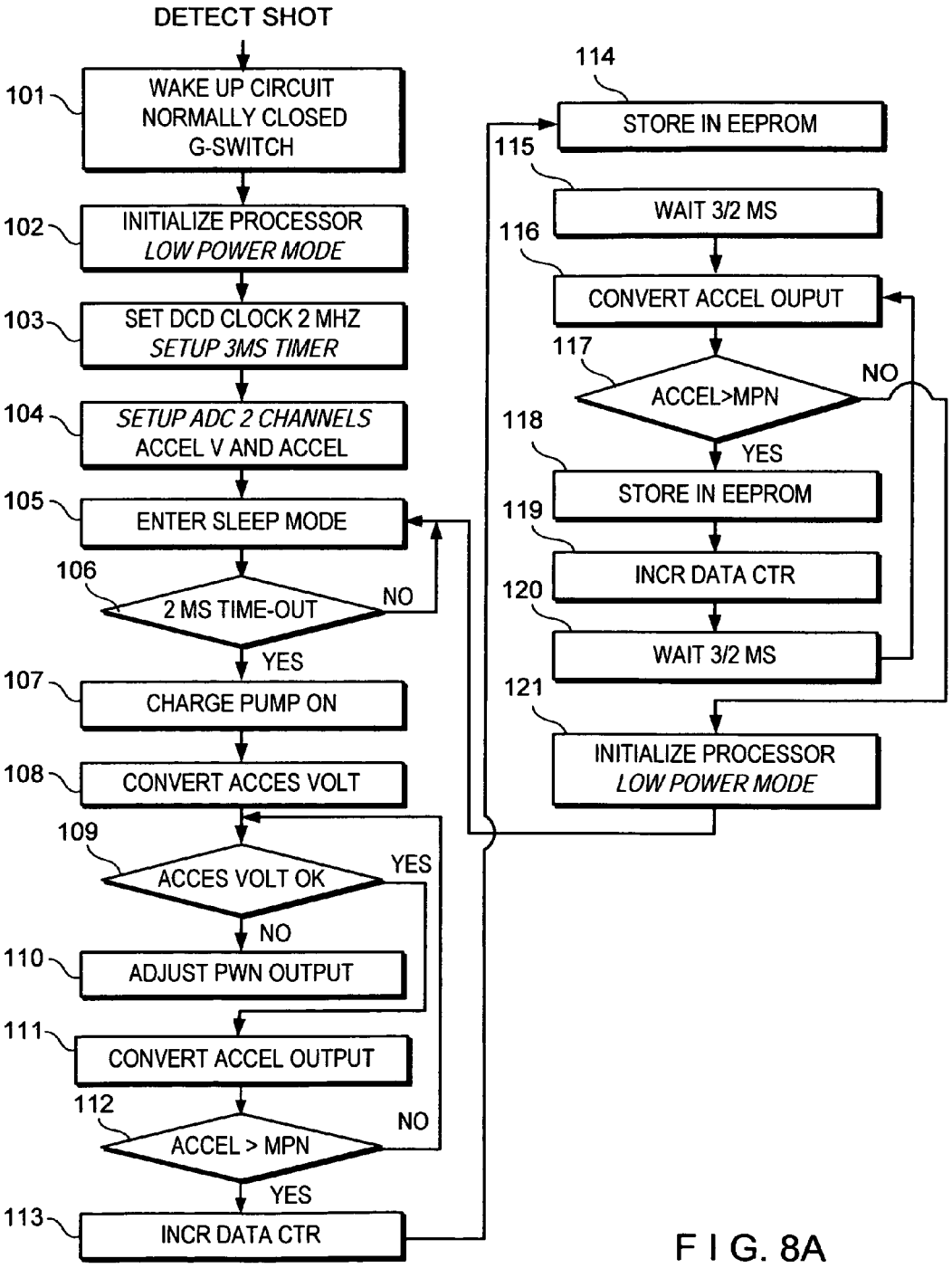
Figure 8B:
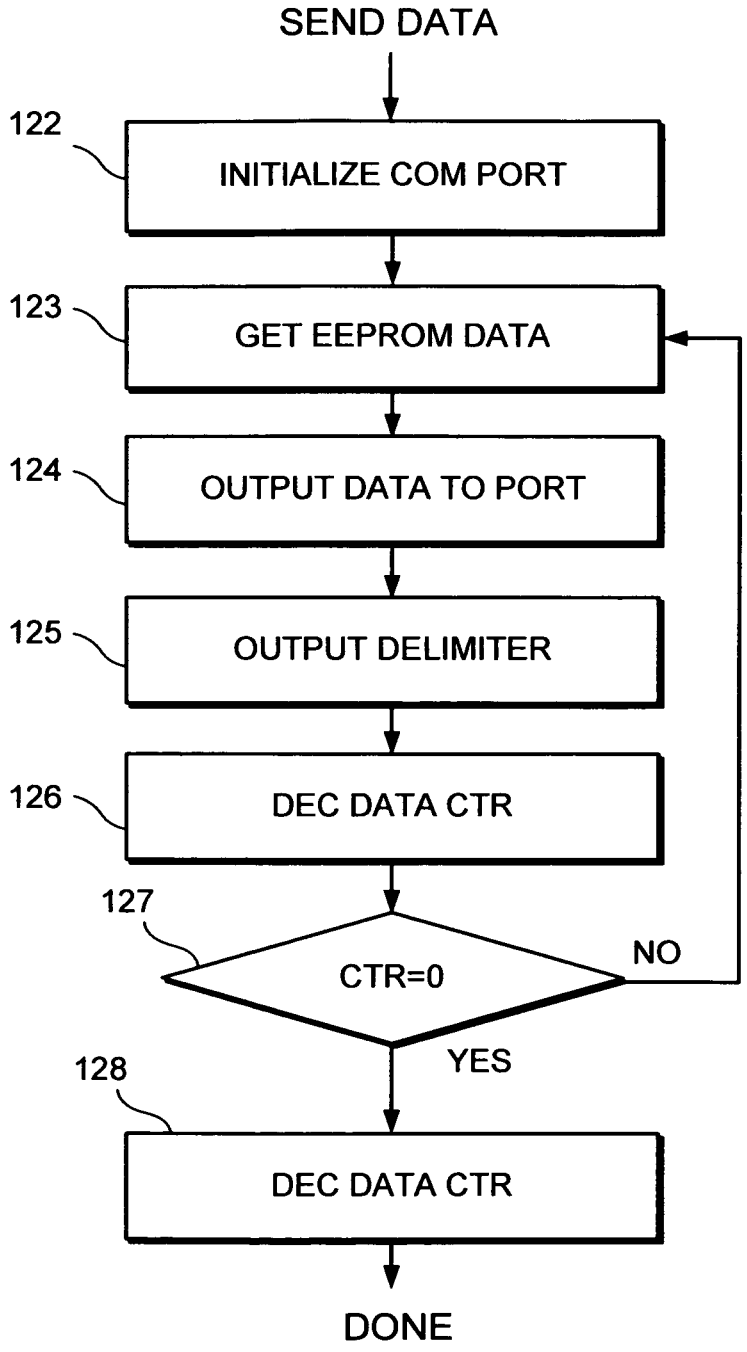
Figure 9:
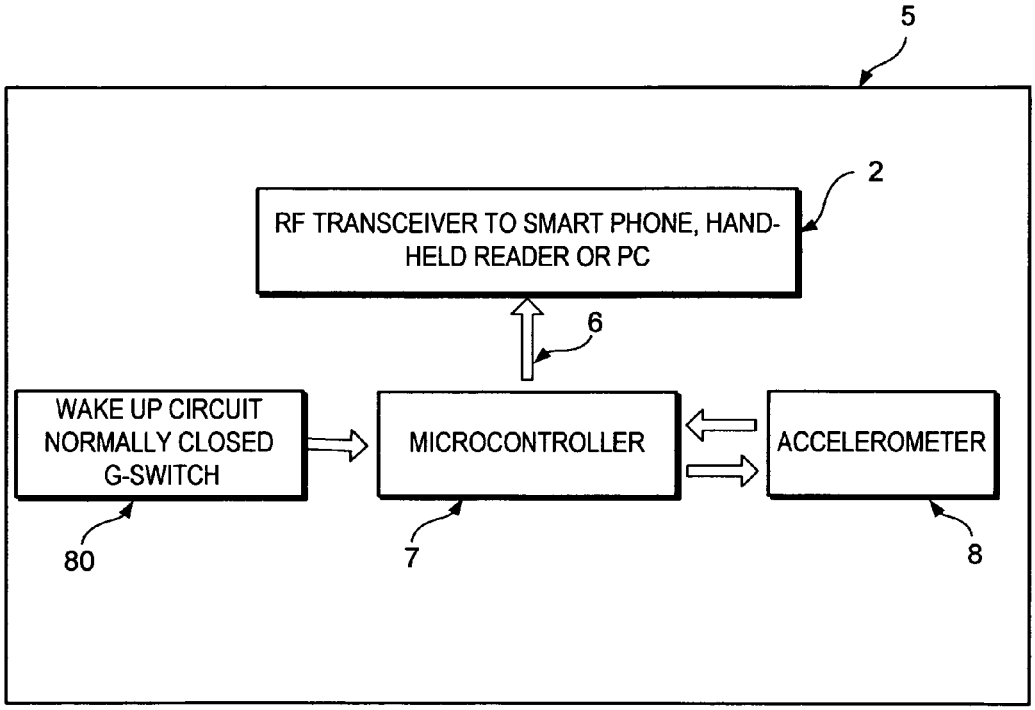
Figure 11A:
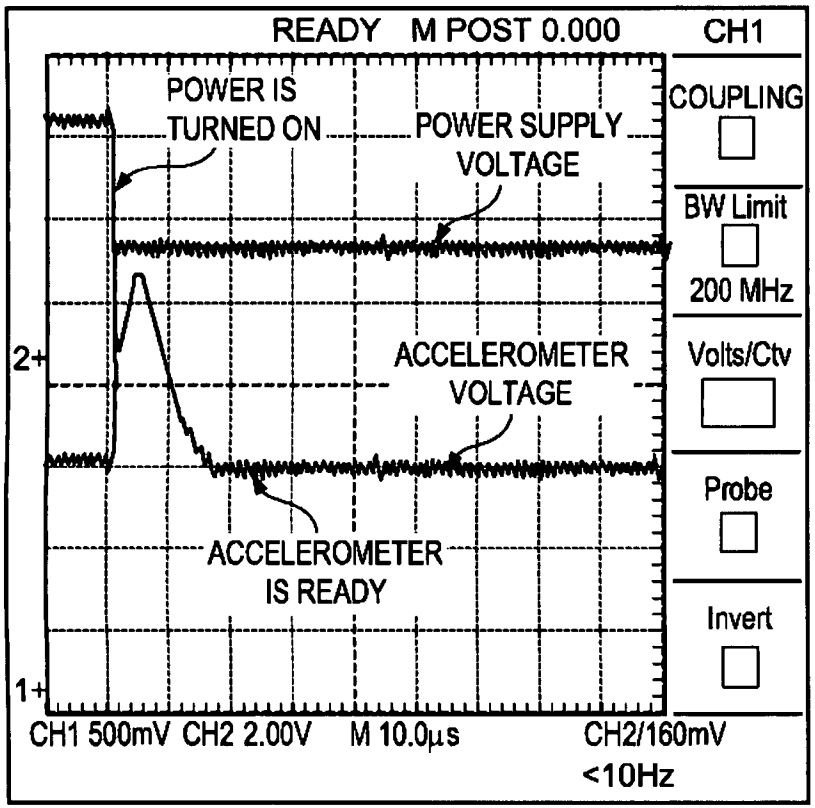
Figure 11B:
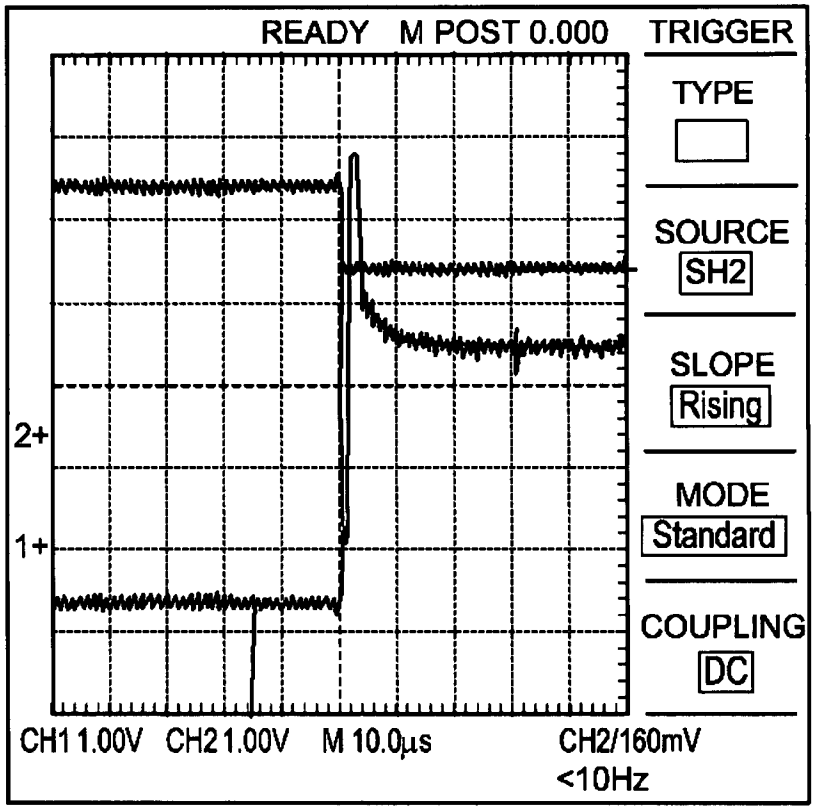

FIG. 2A the operational flow chart for the detection of a shot being fired and FIG. 2 B shows the operational flow chart of data being transmitted about the fired shot that was detected;

FIG. 3A is a illustration of the MEMS Sensor deflection under given G Load vs. time of the shot;

FIG. 3B is a graph illustrating G force due to a shot fired versus time;

FIG. 4 is a partially exploded view of one embodiment of a handgun grip attachment of the module of the present disclosure; and FIG. 5 is a partially exploded view of another embodiment of an attachment of the module of the present disclosure to a barrel of a firearm;

FIG. 6 illustrates a rotational measuring direction in which a firearm will twist in the direction of the rifling as the bullet expands and engages the groves in the rifling as the bullet is fired; and FIGS. 7-9 illustrate another embodiment of the present disclosure in which a wake up circuit is utilized in with the microcontroller and the accelerometer in which:

FIG. 7 is a block diagram similar to FIG. 1 showing the wake up circuit as a part of the circuitry of the present disclosure;

FIGS. 8A and 8B are operational software diagram of the microcontroller operation of the module of the present disclosure showing the wake up circuit in which:

FIG. 8A shows the operational flow chart for the detection of a shot being fired and FIG. 8B shows the operational flow chart of data being transmitted about the fired shot that was detected;

FIG. 9 is a block diagram showing the operational direction for the present disclosure with the wake up circuit;

FIG. 10 is a graph for a typical shot pulse for an AR-15 weapon;

FIGS. 11A and 11B compare normally open and normally closed switches;

FIG. 12 is a flowchart of a shot detection algorithm process utilized in the present disclosure;

FIG. 13 is a graph showing Young's Modulus versus time for various metals;

FIG. 14 is a flowchart showing detection of over or under pressure event in accordance with the present disclosure; and FIG. 15 is a flow chart showing a self-calibrated procedure in accordance with the present disclosure.

DETAILED DESCRIPTION OF THE PREFERRED EMBODIMENTS

Referring now to the drawings of FIGS. 1-15, FIG. 1 is a block diagram of the circuit of the module 5 of the present disclosure.

The module 5 can be battery powered by way on non-limiting exemplary illustration, a lithium battery 3—such as a 3.6 V lithium battery. The circuitry of module 5 can be mounted on a printed circuit (PC) board 6. The circuitry of the module 5 includes a microcontroller 7 programmed to operate the module 5, a MEMS accelerometer 8, an RF 2 module or any other preferred serial communications link that can transmit by RS 232 standard, Bluetooth, or awave and a flash memory or other suitable non-volatile memory such as an EE Prom 10.

The microcontroller 7 controls the operation of the module 5. The accelerometer 8 is in the plane of firing of the firearm and provides and measures the actual G force of each round fired by the firearm. The microcontroller 7 converts the analog output of the accelerometer 8 to a digital recorder. The microcontroller 7 interrogates or periodically samples the accelerometer 8 at its output, preferably every 10 milliseconds. If the samples taken by the microcontroller 7 exceed a predetermined threshold, a shot is counted by the microcontroller 7. The microcontroller then continues sampling until the accelerometer output falls below the threshold level at which point the time and profile of the shot is recorded.

The data for the shot profile is stored in the EEPROM 10 or other flash memory. It is then transmitted remotely to a remote location such as a remote computer terminal via a serial communications device such as the RFID device 2, which converts the flash memory data into a serial format conforming to RS 232 standard, Bluetooth or awave for transmission to the remote computer station. The flash memory 10 includes instructions at every command back to start to prevent the firearm unit to which the module 5 is attached from being lost The accelerometer 8 is a two-axis MEMS accelerometer and is in the plane of firing and it provides and measures the active G force of the shot fired by the firearm. The shot profile information collected will include the recoil and rotation of the barrel due to the shot. The data will continue be collected until the acceleration level falls below the threshold programmed. At this point, the number of shots fired is tallied up and recorded for this round. In addition to recoil sensor data, duration and shots counted, the type of round fired is identified, and the time and profile of the shot fired is recorded and transmitted.

One type of MEMS accelerometer that can be used is ANALOG DEVICES AD22283-B-R2. The microcontroller can be a MSP430F12321DW(SOWB) or an MSP430F12321PW(TSSOP). The Flash memory can be ATMEL ATT25F2048N-10FU-2.7. It is understood that the present disclosure is not limited to any particular cards and the above are listed as non-limiting illustrative examples.

The present disclosure further includes a charge pump (not shown) for raising the battery voltage to the necessary power to operate the MEMS accelerometer 8.

The remote computer terminal will have a computer software package that resembles the data from the module 5 and logs it into a file to be input to an EXCEL spread sheet where it can be displayed as a bar graph or raw data. By way of non-limiting illustrative example, commercially available RF transmitter chip sets can be used with firmware to permit the RF chips to communicate with a remote location such as but not limited to a wireless PDA.

Figure 2B:
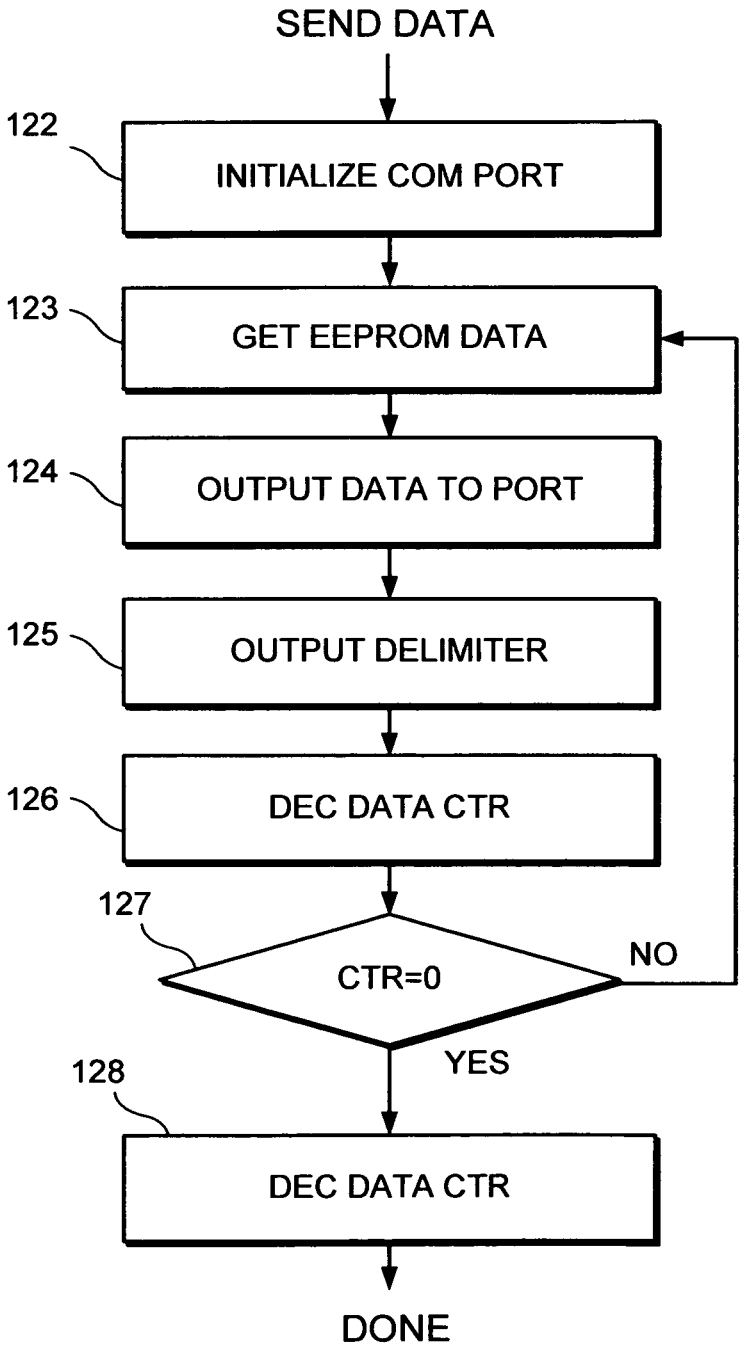

FIGS. 2A and 2B illustrate the firmware of operation of the microcontroller 7 for the module 5 of the present disclosure. FIG. 2 is a first flow chart illustrating the detection of a shot with the present disclosure. In step 102 upon a shot being fired, the microcontroller initializes the processor's low power mode (step 102). A timer is set as noted in step 103 for the accelerometer. This step takes place for the accelerometer in step 104. Sleep mode for the accelerometer is entered into in step 105. Has the set up time expired as asked in step 106—if not return to sleep mode (step 105), if yes go to step 107 and the charge pump on the accelerometer voltage is converted in step 108 and if it is at the correct voltage level as checked in step 109 then the accelerometer output is converted in step 111. If not the right level, it is checked again in step 109. If the accelerometer meets the minimum level in step 112 then the data is incremented (step 113) and stored in an eeprom (step 114).

After ½ millisecond (step 115) the output of the accelerometer is converted (step 116) and checked against the minimum (step 117) then the data is incremented (step 118) and stored in an eeprom (step 119) and after a wait for ½ msec (step 120) the counter is incremented (step 121) and returns to sleep mode step (105).

In FIG. 2B data is sent by first initializing the communication port (com port) step in 122 and then getting the stored eeprom data step 123 and then outputting the data to the port in step 124. Step 125 is output delimiter for delimiting the data output in step 124. The data counter is decremented in step 126 and if the counter is at zero the communication port (com port) is disabled in step 128. If the counter is not zero then the data is secured from the eeprom in step 123.

FIG. 3A shows the MEMS Sensor deflection under given G Load vs. time of the shot.

FIG. 3B illustrates the shot profile date that can be graphed from the information obtained by the module 5 of the present disclosure.

FIG. 4 shows a partially exploded view of the module 5 as part of an attachment to the pistol grip of a handgun in one embodiment of the present disclosure.

FIG. 5 shows a partially exploded view of the module 5 as part of an attachment to the barrel of a firearm in another embodiment of the present disclosure. FIG. 5 shows a shot counter housing 51 for the self calibrating shot counter weapon of the present disclosure having a rail mount 52 that is used for mounting accessories. The module 5 is shown and as can be seen in FIG. 5, a lithium battery 3, a microcontroller 7 and an MEMS accelerometer 8 are mounted thereon. A rail mount 56 for the self calibrating weapon shot counter of the present disclosure is shown as by way of non-limiting illustrative example a Picatinny Rail mount 56 having a recess 2*a* for placing the rail mount on a barrel of a firearm.

FIG. 6 shows the rotational measuring direction, the firearm will twist in the direction of the rifling as the bullet expands and engages the groves in the rifling as the bullet is fired. It is necessary to take this measurement in account to determine the different caliber and weight of bullets fired. FIG. 6 shows the direction of travel when a firearm is discharged (as shown as 61); the grooves 62 in rifling twist to right as they pass down the barrel; the bullet-projectile, the front sight at 12 o'clock position zero degrees before cartridge ignition 42; the negative or return direction after firing 65; and the rotational direction when rifling is twisted to the right 66.

FIGS. 7-9 describe another embodiment of the present disclosure in which a wake up circuit is added. As seen in FIG. 7, the wake up circuit 80 (FIG. 9) serves to resolve the problem when an accelerometer does not wake up fast enough to capture the entire energy pulse, a common problem associated with off the shelf accelerometers. The wake up circuit can be a normally closed g switch (gravity switch) with a quicker response than that of the accelerometer 8 employed in the present disclosure. The g switch 80 also provides for power conservation due as it is a mechanically triggered switch. Upon detecting a shot fired the g switch or wake up circuit switches from its normally closed state to an open state and transmits a signal to the micro controller (see FIG. 9). The microcontroller sends a signal to the accelerometer to initialize the process low power mode thus turning the accelerometer on. The accelerometer sends data to the Microcontroller and which sends the information via RF transceiver to a smart phone, hand held reader or a personal computer (PC) (FIG. 9). The microcontroller determines the mode of data transfer. There are three modes of transfer: In MODE 1 the microcontroller gathers the data on board and goes back to sleep waiting for a prompt from a reader or PC to down load data. In MODE 2 the microcontroller sends data after every shot to a smart phone, PC to attach GPS location from the cell phone and text weapon use, position location to a preset number for the purpose of providing automatic shot notification. MODE 3 is the engineering mode where the microcontroller sends data is of the entire accelerometer signature to a smart phone or PC. FIG. 8 shows the wake up circuit step which when switched to an open state from its normally closed state proceeds to initialize the processor low power mode.

FIGS. 8A and 8B illustrate the firmware of operation of the microcontroller 7 for the module 5 of the present disclosure. FIG. 8A is a first flow chart illustrating the detection of a shot with the present disclosure. In step 101 the wake up circuit, which is normally closed, is set to open upon detection for a shot being fired (step 101). The wake up circuit causes the microcontroller to initialize the processor's low power mode (step 102). A timer is set as noted in step 103 the accelerometer. The step is takes place for the accelerometer in step 104. Sleep mode for the accelerometer is entered into in step 105. Has the step up time expired as asked in step 106—if not return to sleep mode (step 105), if yes go to step 107 and charge pump on the accelerometer voltage is converted in step 108 and if it is at the correct voltage level as checked in step 109 then the accelerometer output is converted in step 111. If not the right level it is checked again in step 109. If the accelerometer meets the minimum level in step 112 then the data is incremented (step 113) and stored in an eeprom (step 114).

After ½ millisecond (step 115) the output of the accelerometer is converted (step 116) and checked against the minimum (step 117) then the data is incremented (step 118) and stored in an eeprom (step 119) and after a wait for ½ msec (step 120) the counter is incremented (step 121) and returns to sleep mode step (105).

In FIG. 9B data is sent by first initializing the communication port (com port) step in 122 and then getting the stored eeprom data step 123 and then outputting the data to the port in step 124. Step 125 is output delimiter for delimiting the data output in step 124. The data counter is decremented in step 126 and if the counter is at zero the communication port (com port) is disabled in step 128. If the counter is not zero then the data is secured from the eeprom in step 123.

The shot counter of the present disclosure as described herein can be configured with various combinations of components and capabilities to provide multiple functions for a variety of applications. In the foregoing descriptions, these combinations and applications are grouped according to the following topics: components, data gathered, communication modes, configuration data, algorithms, self-calibration, applications, and mounting locations on a small arms weapon.

1. Components

The primary sensor for the shot counter is a linear accelerometer, having the ability to measure accelerations of both polarities, and mounted such that the sensitive axis is aligned with the direction of fire for a bullet exiting the barrel of the weapon (called herein the x axis). An optional second linear accelerometer may be mounted with its sensitive axis perpendicular to the x axis, and parallel with the long dimension of a typical trigger, which is also the vertical axis when a standing shooter is firing the weapon with the x-axis pointed at the horizon of the earth (this is the z axis). As the bullet is projected from the breech and through the barrel the remainder of the weapon will experience a recoil according to Newton's third law, representing the conservation of momentum. This recoil will be greatest along the x-axis. A lesser amount of acceleration will be experienced in the z axis, especially if a line passing through the center of the barrel does not pass through the center of mass of the weapon, or through the center of rotation for the weapon, its mount, and the portions of the shooter's body holding the weapon. An even smaller acceleration is experienced orthogonal to the x and z axes (the y axis). A further option is to include a third accelerometer in the y axis, providing full 3-D linear acceleration in a right hand rule set of Cartesian orthogonal axes. In addition, due to rifling of the barrel interior, there will be a rotation imparted to the bullet as it travels through the length of the barrel. Again, according to Newton's third law, the barrel, and hence the weapon to which it is affixed will experience a rotation in the opposite sense. This roll rotation about the x axis may be detected by an optional angular rate sensor mounted within the shot counter. Other angular rate sensors may also be used, such as a pitch sensor to measure rotation about the y axis, measuring the kick-back of the weapon as it recoils. A yaw sensor about the z axis is of little value in shot counting, but may be optionally included to provide, through an integration of angular rate together with correlation to a reference angle, an indication of the direction in which the barrel is pointed. Together, these six motion sensors are capable of monitoring the entire range of movement of the weapon, and changes along these six independent degrees of freedom, which may occur as a result of the weapon being fired. These six signals, or a subset thereof, may be stored as raw data, or as compressed raw data using compression schemes, which are evident to those skilled in these arts, for immediate or later processing. In this preferred embodiment, a microcontroller within the shot counter may use one or more of these signals within an algorithm to determine whether a shot has been fired, and to further determine other metrics or data as may be desired.

For the most accurate data gathering, the accelerometer used should have good resolution and wide bandwidth. For example, commonly used motion-sensitive accelerometers, such as commercially available crash sensors for motor vehicles, include a low-pass filter having a cut-off frequency of typically 400 Hz or 800 Hz, and response times of 1 millisecond or longer. Shot profile characteristics with frequency content higher than the cut-off frequency are attenuated or diminished. To capture the shot profile as early and as accurately as possible, the accelerometer should be fast-acting, that is, it should have a high bandwidth. As one non-limiting example, the ADXL001 accelerometer from Analog Devices, Inc. (Norwood, Mass.) has a bandwidth of 22,000 Hz. When such a fast-acting accelerometer is used, response times can be as brief as 0.05 milliseconds.

The shot counter includes a signal processing and computing device, which may be one or more microcontrollers (also called microprocessors), a programmable logic controller (PLC), a field programmable gate array (FPGA), or an application-specific integrated circuit (ASIC), collectively called herein the micro. The micro is powered by an on-board energy storage system, such as a fuel cell, a lithium battery, or a nickel-cadmium battery, collectively referred to herein the battery. In a preferred embodiment the micro is of a type typically called "low power," and has two modes of operation, namely "normal" operation, and a "sleep" mode, which draws a greatly reduced amount of current from the battery. To achieve a long battery life, the micro is ideally in the sleep mode except when a shot is being fired by the weapon, and except when the shot counter is communicating with an external or a remote device, as will be described below. When the shot is complete, the micro returns to the sleep mode, however it may remain in the normal mode for a sufficiently long duration to capture a subsequent shot, as for example when a self-loading submachine gun is firing shots in rapid succession. The signal to switch the micro from sleep to normal mode is performed with a sub circuit within the shot counter called the wake-up circuit. In a preferred embodiment the wake-up circuit consists of a normally-closed G-switch, which is an electromechanical device in which an electrical contact opens when the g-switch experiences an acceleration greater than a pre-determined threshold. It is the experience of the inventors that a normally-closed g-switch activates much more rapidly than a normally-open g-switch, so the use of a normally-closed g-switch provides an advantage of waking up the micro closer in time to the start of a bullet being fired. As a non-limiting illustrative example, the normally-closed g-switch may be set at 7 gs (one g is equivalent to earth's gravitational acceleration, or about 9.8 meters per second per second). This wake-up circuit, consisting primarily, but not necessarily exclusively of the g-switch, is connected to a digital input of the micro such that when the g-switch changes to an electrically open (no contact) state, the micro will switch from sleep mode to normal mode. In this example, when the recoil of a bullet being fired causes the weapon to experience an acceleration greater than 7 gs, the micro is "woken up" from sleep mode.

The micro may include non-volatile memory either within its own package, or in a separate integrated circuit in electrical communication with the micro, and within the shot counter unit. This memory may be electrically-erasable programmable read-only memory (EEPROM), "flash" memory, magnetic bubble memory, micro hard disk drives, or other such non-volatile memory technologies as may be known to those skilled in these arts. The quantity, speed, and retention time of the memory technology selected may vary depending on the application, and all such combinations are considered included within the scope of the present invention. As an option, the memory may be of a volatile type, such as dynamic random access memory (DRAM), however, this requires a periodic, frequent draw of current from the battery, so that such applications may experience a shorter battery life. A first portion of the memory may be used to store various data relative to the shot counting function and related functions. A second portion of the memory may be used by the micro for storage of the firmware which boots the micro from a powered off state, for storage of the firmware which contains the algorithms (described in detail below), or for storage of the firmware which performs communication functions (described in detail below). The partitioning of the said first and said second portions of the memory may be divided among memory internal and external to the micro, as might be advantageous to the particular configuration or application.

The shot counter unit includes communication means to send and optionally receive information from a remote device, such as a personal computer (PC), a personal data assistant (PDA), a cell phone, an iPad, or other portable electronic device having communications capabilities. In one embodiment, the communication is provided by means of a cable, which is affixed or plugged into a connector within the shot counter unit, and accessible externally. This connection may be a serial or parallel communications port, using protocols which are available to those skilled in these arts, and may include, but is not limited to, RS-232, or USB and its variants and derivatives. The communication means may also be a one way transmitter having an antenna that broadcasts information, using protocols such as amplitude modulation (AM), frequency modulation (FM), or other means of electronic broadcasting that are known to those skilled in these arts. In a preferred embodiment, the communications is performed via two-way protocols including, but not limited to, those known variously as radio-frequency identification (RFID), IEEE 1901.1 (RuBee), IEEE 802.11 (Wi-Fi), and IEEE 802.15.1-2002 (Bluetooth). Within RFID are two methods, known colloquially as active or passive, regarding whether the message is a modulation of the signal transmitted by a RFID reader, or whether the RFID unit transmits information using its own power, respectively. For low power applications, or applications where a minimal electronic signature is required, a passive RFID approach is desirable. When two way communications are used, the shot counter unit is generally provided a signal or message to initiate the communication protocol. Various methods are all considered part of the present invention, and are known to those skilled in these arts. The RFID reader, PC, PDA, or other remote device will perform one or both of requesting data from the shot counter unit or providing data to the shot counter unit. How these communication links are used to effect the multiple functions of the present invention are described in detail below. A further aspect of two way communication is the inclusion of error checking and correcting to provide reliable information from the shot counter unit. The error checking may include a parity bit, a cyclical redundancy check, Manchester encoding, or other method as is known to those skilled in these arts. Note that a shot counter unit may include both two way and one way communications, such that, for example, the two way communication is used to configure the shot counter to temporarily utilize one way communication for purposes such as transmitting engineering data gathered by the shot counter for characterization, analysis, troubleshooting or calibration, as will be elaborated upon further below. As a further option, the shot counter device may include both a wire-connected communications port and a two way wireless communications means, thereby providing redundancy in the ability to download and upload information from the shot counter unit.

The shot counter unit may also include additional components useful for its intended operation, including, but not limited to: a device for producing sound for an audible enunciator to the weapon user; a light emitting device for visual annunciation to the weapon user; and buttons or switches which change the mode of operation, or select certain functions of the unit. The shot counter unit is typically packaged within a housing capable of withstanding the environments in which a small arms weapon is transported and used. Said housing may include one or more methods of being affixed to the weapon, as will be described in a later section.

2. Data Gathered

The signal most useful for shot counting is the x axis acceleration. When a shot is fired, the recoil in the x axis typically includes a number of features, having durations, amplitudes, frequency contents, and noise indicative of various physical processes occurring during the firing of the weapon and the traverse of the bullet down the barrel. FIG. 10 shows a graph of a typical x axis accelerometer trace using the ADXL-001, measured in volts, where the translation from volts to gs is taken by first subtracting 1.71 volts from the voltage, and dividing by 0.024 to obtain gs.

As described in FIG. 10, the micro plus wake-up circuit is set such that the micro will be in sleep mode until the acceleration is above approximately 7 gs. Prior to that time, the micro will not record any acceleration data. Upon wake-up into normal mode, the micro begins recording acceleration data, and typically stores this in volatile memory (for example DRAM). Depending on the application, the micro may then store this raw data into non-volatile memory, the micro may use data compression techniques to minimize the size of memory required, and then store the compressed data into non-volatile memory, or the micro may process the data to derive certain higher level metrics, and store these in memory. Higher level metrics include, but are not limited to: whether a shot was fired; whether the round was a blank or had a bullet; the maximum amplitude of the shot signal; a cumulative sum of the shot signal; duration of the bullet traversing down the barrel; or an indication of the strength of the round, as determined by various algorithm measures, such as will be described below. When additional accelerometers or angular rate sensors are included in the shot counter unit, the micro will have more raw data available, but may also be configured to derive additional higher level metrics, including, but not limited to: roll of the weapon (due to rifling); kick-back of the weapon; shifting of the direction of pointing during the shot; or other suitable metrics, limited only to the practitioner's imagination, as may be derived from the full quaternion description of the motion of the weapon during the shot.

There may be movements or accelerations of the weapon which are not directly related to a shot, but which may provide valuable data for the purposes of determining when service or replacement is required. Such generally requires that there be at least a minimum amount of acceleration so that the wake-up circuit activates the micro. This may happen, for example, when there is a jam in the gun. In this example, the micro may sense the pull of the trigger, possibly the release of the firing pin, but fail to record the explosion of the round going off. It may be advantageous to record this information, or the number of times a jam occurred, in order to indicate to a remote device the need for weapon cleaning, repair, or retirement. In other examples, it is known that users may sometimes use the weapon for purposes other than those for which it was intended, including using the butt stock of a rifle as a hammer, or using the side of the barrel to strike an object. These actions may activate the micro, fail to result in a shot count, but a recorded signal, or its higher level metrics, may be used to save this information so that, for example, it might be determined that the weapon is now unsafe to fire. Annunciation of an unsafe condition may be provided through the remote device using the communications methods described above, or through the annunciation methods, also described in FIG. 10.

3. Communication Modes

The primary function of the shot counter is to maintain a record of shots fired, and other data, until such time as a user wishes to upload this information. In this mode, the shot counter operates independently and automatically provided there is sufficient energy remaining in the battery. When a user desires to know the shot count, or to extract other metrics such as: (1) round count; (2) weapon identification number, (3) round caliber; (4) barrel type; (5) time and date; (6) overpressure or underpressure; or (7) history log, a means is provided which results in the shot counter unit supplying this data to a remote device through one of various communication modes. As a first example, the shot counter unit is provided with an antenna through which it may receive a signal from a wireless transmitter capable of sending messages. When the appropriate security measures have been met, such as password protection, encryption (PGP for example), or secure cable, the remote device sends a command to the shot counter unit requesting the information desired. The shot counter unit is programmed to provide such data as is requested through the physical hardware layer employed in the particular application. In the case where a user wishes to know how many shots he or she has fired in a given session or time frame, he or she may request the present shot count, and subtract from it the shot count prior to the given session or time frame. Alternatively, the shot counter unit can be configured such that every time the shot count is accessed and uploaded to a remote device, the shot count is reset to zero. With two-way communication, wired or wireless, the remote device issues commands, and the shot counter unit delivers messages, according to a common protocol programmed in the firmware of the shot counter unit. These two-way communications will in general include error checking, as described above, so that the exchange of information is truly bi-directional.

When the remote device is in communication with the shot counter unit, the remote device may issue commands, which put the shot counter unit into one of various possible states of operation. Suppose the default state is for the shot counter unit to operate as described above, gathering and storing data until commanded to upload the data. Another state of operation which may be entered through a command from the remote device is for the shot counter unit to stream engineering data output. For purposes such as characterization of the shot counter performance, or the behavior of the weapon on which it is installed, one may wish to have a full profile of sensor data. In this example, it may be desired to obtain sensor data for the entire shot pulse, such as is shown in FIG. 10. If more than one motion sensor is included in the shot counter unit, it may be configured to send one, some, or all of these profiles. In general, the amount of data gathered by the microprocessor may be large compared to the bandwidth of the communications link. In such cases, it may be possible to compress the data, either in real-time, or if memory is sufficient, off-line. Real-time data compression techniques such as BSTW and Lempel-Ziv coding may be used, or other methods known to those skilled in these arts. In general, if the data requested requires longer than the time between two successive shots, the shot counter unit may be configured such that the sensor data is stored or sent after the next shot fired, but to ignore any other shots, which occur until the data from the first shot has been completely delivered. With sufficient communication bandwidth, real-time data can be streamed continuously, if desired.

In an alternative embodiment, the shot counter unit may include two or more means of communications such that the ability to deliver full sensor profiles is enhanced. One such means is to provide one-way communications, such as AM or FM transmission through a suitable antenna, or through a wired communications cable. In this way, it is possible to continue shot counting and related metric detection while simultaneously delivering sensor data for analysis or for calibration. This configuration is one means by which self-calibration can be effected, as will be described below. This configuration has a further advantage in that when a cable is used to deliver commands from the remote device to the shot counter unit, and one-way communications are used only when so configured, when one-way communications are not turned on, then the shot counter unit is less likely to be identified by a hostile entity conducting electronic searches for RFID devices. To illustrate this point, suppose an unfriendly combatant is seeking to identify the location and number of weapons equipped with shot counting capabilities, perhaps to use this information to target munitions thereto. With RFID and other two-way wireless communications, it is possible for the unfriendly entity to "ping", or otherwise electromagnetically excite, the responsive circuitry within the shot counter unit. Although security means may prevent a two-way wireless communications link from being established, it may be sufficient for the enemy's purposes to simply know that you are nearby. With more sophisticated equipment, it is even possible to triangulate onto the position of a two-way wireless communication capable shot counter unit. For such applications, a wired two-way communications port with one-way wireless capability may provide superior ability to evade unwanted detection.

In certain applications, the user may wish to rapidly switch between various states of operation. The present disclosure provides for this through the inclusion of a switch or button on or in communication with the shot counter unit to switch state. This may be useful for training purposes, such as when a master gunnery sergeant may desire to check out a given weapon to identify a malfunction, or to provide feedback to the weapon user. Sensors included in the shot counter unit can convey useful information such as how steadily the weapon was aimed, how much kick-back the user allowed, or how much the weapon twisted in the grip of the user. To prevent data collisions when multiple weapons may be in the electronic vicinity, a switch or button to enable output of a full sensor profile could be a considerable convenience.

4. Configuration Data

Every firearm has a serial number. Modular weapons systems include serial numbers for each swappable component. Because an object of the present invention is to keep a record of the total number of shots fired through a weapon, it is desirable to include an electronic weapon identification (ID) number in the shot counter unit memory. The original setting of this electronic ID number can be performed at any time. As one example, it can be downloaded (or "burned") into the micro non-volatile memory during the manufacturing and assembly operation in the weapon factory, for example, as part of the firmware object file. As another example, the ID can be downloaded via two-way communication using a suitable communications mode as described above. This ID number, along with the associated number of counts, would then be accessible, assuming properly authorized access, to a remote device through one or more of the communication modes described above. For modular weapons, the present invention anticipates a multi-part ID number, where various parts correspond to various components, such as the frame, the barrel, the stock, the receiver, the magazine, and additional add-on components, for example, a grenade launcher. When a warfighter, Gunnery Sergeant, amorer, or peace officer configures a modular weapon, the electronic ID can be updated through two-way communications. In this way, it is possible to determine a cumulative total life count of rounds fired for each component. This is an advantage for cost and inventory because the barrel may require replacement more frequently than the stock. In this way, a lightly-used, wear-resistant component can be re-used in a new weapon configuration, thereby reducing the need to procure and store all components of a new weapon.

Some weapons, such as the Special Operations Forces Combat Assault Rifle (SCAR) made by FN Herstal, have the ability to switch between three different barrel lengths without other modification to the weapon. As will be described in the algorithm section below, it is possible to determine the length of the barrel through processing of the sensor signals. In this manner, the shot counter unit can associate a barrel length with a shot, or a grouping of shots. Grouping of shots may be done by time. As an alternate embodiment, there may be a mechanism provided whereby the shot counter unit can detect when a magazine is changed, and the grouping could be from one magazine of bullets to the next.

Additional data, which may be stored in the memory of the shot counter unit, include the caliber of bullet for which the weapon is configured. In certain cases, some weapons have the ability to accept multiple calibers. When changing caliber requires a hardware modification, this information can be stored in the shot counter unit memory. If the weapon can accept multiple calibers without modification, it is possible that the algorithm can detect the caliber used. In such case, the algorithm may record into memory the caliber of bullet used with each shot, or grouping thereof.

In many applications it is desirable to record the time at which a shot was fired. A typical micro includes internal timers, which can be used to continuously record elapsed time provided there is power available from the battery. For a micro having a sleep mode and a normal mode, continuous activation of the internal timer requires in general a greater power consumption in the sleep mode. Thus, use of an internal timer for a given battery capacity will require battery replacement earlier than without the timer being active. More accurate timing is available with an external crystal oscillator, capable of providing accuracy comparable to an electronic timepiece or wristwatch. An external oscillator will generally require an even greater current draw than an internal timer will, and this current draw will occur even when the micro is in sleep mode. Thus, the more accurately the time is measured, the shorter the time between battery changes. In the present invention, all such combinations are anticipated, and are generally dictated by the application, several of which are described in more detail in a subsequent section.

Additional configuration data relevant to the shot count and the weapon include detection of over- or under-pressure events, such as when a round may, during manufacture, have too little or too much powder. As will be described in the section below, detection of over- or under-pressure events may be recorded with each shot, or alternately, the number of overpressure and the number of underpressure events may be stored. This information may be used to understand the impact on the weapon, but also for quality control purposes with the manufacturer of the rounds used in the weapon.

Provided there is sufficient memory within the shot counter unit, it may also be desired to store a maintenance log. Thus, a weapon, which arrives at a depot, carries with it a record of its prior history. This information may be useful to the armorer when deciding what components are ready for replacement, which may need repair, how much cleaning may be required, or to determine if there is a problem with the weapon itself.

5. Algorithms

Various algorithm functions have been described above, and are presented in more detail in this section. An algorithm is defined in many ways, but for the present purpose may be taken as "a set of instructions or rules that combine to accomplish a task". One function, which may be construed as not strictly adhering to this definition, but is included in this section, is the function of the wake-up circuit.

a. Wake-Up Circuit

The aforementioned US Patent Publication No. 2009/0016744 to Joannes et al. describes a wake-up circuit whose purpose is to conserve power when the weapon is idle. A normally-open ("N-O") switch is described (two, actually), which is used for the purpose of bringing the microprocessor from "sleep" mode to "active" or normal mode. A N-O switch has fundamentally inferior time performance characteristics compared to a normally-closed ("N-C") switch. The response time for a N-C switch is much faster (25-30 microseconds) than for a N-O switch (2000 microseconds or 2 ms). This is because the mechanical element within a N-C switch only requires an infinitesimal distance of travel to change state, but a N-O switch has a finite travel distance required before the mechanical element will close. FIGS. 11A and 11B show side-by-side a standard and a fast-acting switch on an oscilloscope trace, respectively. Therefore, use of a N-C switch, as taught in the present disclosure. will result in an earlier wake-up time. By waking up more quickly, the system captures a more complete record of the shot pulse, and therefore deliver superior performance. FIG. 10 shows an actual shot pulse from a machine gun, and the bar at the bottom represents a time span of 2500 microseconds from the start of the shot pulse. It is clear that such a long wake-up time, associated with N-O switches, misses the most significant and important portion of the shot pulse.

b. Shot Detection Algorithm

The algorithm utilized by the present disclosure for detection of a shot fired is described herein with reference to the flow chart of FIG. 12, and within this shot detection algorithm are four primary measures. Each measure captures a specific characteristic of the x-accelerometer signal. The measures are designed in such a way that they elicit different responses between live shots and non-shot events. However, any given measure, by itself, is generally insufficient to give a clean discrimination between live shots and non-shots. Thus, the algorithm incorporates timing, thresholds, and Boolean logic to combine the various measures together in such a way that a live shot is well-separated from non-shot events.

It is instructive to separate the shot detection algorithm into four categories of firmware functionality. These are:

1. Measures—signal processing routines extracting features from the accelerometer signal;
2. Logic—if-then statements applied to the measures to separate live shots from non-shots;
3. Calibration—numeric values used in thresholds for signal strength or time duration; and
4. Decision—combines the previous elements into a final determination of a shot.

The measures, logic, and decision portions are reasonably universal. Calibration parameters may require optimization, and since these are simple numeric values, they are easy to change. A schematic description of the algorithm logic is depicted in FIG. 12.

Measure 1: Slew Rate

Slew rate is the speed of rise of a monotonically-increasing signal. During a live shot, the weapon recoils. The push-back of the recoil generates a high slew rate, which extends for about 0.3 milliseconds. Non-shot impact events also have high slew rates. The difference comes in the starting point. A live shot has a large slew rate starting from near zero acceleration, while a non-shot impact will tend to grow a sinusoid having high slew rates but centered around zero acceleration. By restricting the slew rate to negative values, a distinction can be made between live shots and non-shots. Like other measures, this is not a 100% guarantee. The logic of the algorithm must weigh these various measures to make the final determination of a count.

Measure 2: Cumulative Absolute Value with Decay

Simple summation of absolute value of the x-axis accelerometer signal, provided it is larger than some minimum (to omit noise) at each time step (preferably about 80 microseconds). This value is attenuated by a sub-unity multiplicative factor at each time step. This acts like a crude high-pass filter, which spikes high with a strong signal, then fades out over time. This measure will always be positive. Overall this is a crude, but efficient and effective measure of the energy of the signal. Unless this measure is high, it is not a shot.

Measure 3: Cumulative Signed Value with Decay

Simple summation of accelerometer signal at each time step. This measure is also attenuated by a sub-unity multiplicative factor at each time step. The overall result is equivalent to a velocity calculation with a crude high-pass filter, which returns the signal to zero shortly after the appearance of any significant signal. This measure may have either positive or negative polarity. During the strongest signal of a live shot, this measure will have the same polarity as Measure 2; whereas during a butt strike these variables will have opposite polarity.

Measure 4: Zero Crossings

The purpose of using zero crossings is to understand how much jerk is in the signal. Technically, jerk is the derivative of acceleration. By monitoring the number of times the acceleration reverses polarity within a time window, a measure of the impulses being applied can be had. For a true shot, the impulse will tend to be large and one-sided as the weapon is pushed back. However, mechanical impacts, from dropping the weapon, or striking the barrel or butt will tend to vibrate with an average signal closer to zero. In more severe non-shot events, there are many zero crossings within a short time window. Thus, this measure can be used in a reverse manner, as will be explained below, where too many zero crossings indicate a "twang", whereas a shot will have relatively fewer zero crossings, especially during the primary power pulse.

Timing and Boolean Logic

Referring to FIG. 12, FIG. 12 shows the schematic logic chart 130, described in detail below. First an accelerometer signal is received by the system of the present disclosure (step 131). Next the slew rate is analyzed (step 132). If the slew rate is high (step 133) then the timer 1 is examined to see if the timer has expired (step 134). A high, clean slew rate in the accelerometer negative x-direction is a strong indicator of a shot. The negative-going haversine reflects the recoil in the weapon from the bullet being discharged from the barrel. Once a high slew rate is detected, a first flag is set and timer 1 is started. The timer is used to allow the slew rate to persist for a brief period of time so that the other, slower measures, have a chance to fully develop their maximum values.

If the timer 1 is still active, the program looks for both the absolute (135) and the signed cumulative sums (136) to exceed their respective values. If both absolute and signed values exceed their threshold simultaneously in the same time step, then a second flag is set (137), and timer 2 is started (138). Timer 2 (138) is used to allow this level of detection to persist for a brief period of time to protect against drops in these values from the decay, and so that the zero crossings (139; 140) can be detected within a time window.

At any time that timer 2 (138) is active, and the number of zero crossings is less than a given number (140), a shot is counted (141). Once a shot is counted, timer 3 is started. Timer 3 (142) suppresses the detection of another shot for a relatively long period of time. This is used because a live shot includes three severe events with large accelerometer signals, following one another in sequence as the bolt shuttles back and forth within the machine gun. Timer 3 (142) reduces the risk of beta error from the second and third sub-pulse.

Algorithm Calibration

Calibration values are those numeric thresholds or counts that are used by the shot detection algorithm logic. The following table captures the main caliberatable parameters. These are optimized per a particular weapon platform, and in general, some of these will need adjustment for new platforms. The time step for Table 1 is 80 microseconds.

TABLE 1

Calibration Parameters for Shot Detection Algorithm

| Calibration Parameter | Nominal Value | Function |
|---|---|---|
| w | 0.25 volts | Lower limit at which to start counting cumulative sums. |
| atten_cum | 0.98 | Multiplicative amount to diminish cumulative sums each time step. In firmware, this will be segmented into bins with a varying amount of reduction in counts. |
| window_size | 40 | Number of time steps for moving window for zero crossings |
| xing_thresh | 0.1 volts | Minimum change from zero-acceleration level (nominally 1.73 volts) to count as having crossed zero (noise is about 0.05 volts RMS). |
| slew_big_step | 1.1 | Largest slew rate value (negative from zero-acceleration level |
| acs_thresh | 6.8 volts | Threshold of absolute value accumulation. |

TABLE 1-continued

Calibration Parameters for Shot Detection Algorithm

| Calibration Parameter | Nominal Value | Function |
|---|---|---|
| scs_thresh | 2.25 volts | Threshold of signed cumulative value. |
| hold_flag1 | 15 | Number of time steps to hold timer 1 (slew rate) |
| hold_flag2 | 40 | Number of time steps to hold timer 2 (cumulative sums) |
| hold_flag3 | 500 | Number of time steps to suppress looking for next shot. |
| num_xings | 4 | Maximum number of zero crossings within window_size to still be considered a live shot. |

Decision

When timer 1 has enabled the detection of both absolute and signed cumulative sums, and started timer 2, and when timer 2 has enabled the detection of a limited number of zero crossings, the algorithm counts a live shot, and starts timer 3 to suppress for a while the detection of the next shot. This logic permits a real-time detection of a shot fired. The suppression time (timer 3) is set to be less than the difference between the minimum possible duration between successive shots and the execution time of the above logic.

c. Count Increment

The logic described in Ser. No. 12/380,375 illustrates one method of incrementing and decrementing the cumulative shot count. In that description, when the shot count is uploaded by an external or remote device, the value in the memory is decremented by one each time the remote device uploads one shot. An additional method, which operates more quickly, provides for the remote device to issue a message or command which requests a return message containing the value in memory. The shot counter unit then provides the requested total count. A second command from the remote device may be used to reset, or to zero-out, the count, should that be desired. In the present invention, either method is possible, but the latter is the preferred embodiment.

d. Round Strength/Caliber and Over- or Under-Pressure

It is obvious from Newton's third law that larger bullets and more powerful powder charges within the round will each increase the amplitude of the acceleration recoil experienced by the weapon. This principle, in theory, allows one to determine round strength or caliber, or powder charge high or low (over- or under-pressure, respectively), compared to a given baseline. In a practical system, the repeatability of this signal must be sufficient that the size of the change expected (in caliber or powder charge) is larger than the noise inherent in measuring the motion of a weapon. Furthermore, there will be variations in the mounting of weapons, even within a given design. For example, the M-240 .30 cal machine gun is designed to mount either on a pintle attached to a light armored vehicle, or on a prone-position tripod resting on the ground, or hand carried by a warfighter. The degree to which vibrations are sensed depends on how and where the weapon is attached to some other body or structure. Further complicating detection of caliber or powder charge are changes in the thermal state of the weapon. For example, in a cold weapon, the mechanical springs inside the weapon will have a lower spring constant (less compliant) than when the same weapon is warm. A cold reloading spring will respond more slowly than a warm spring, so the timing of the various pulses will change. As another example, the stiffness of steel, as measured by Young's modulus, is higher at lower temperatures (see FIG. 13). When the bolt hits the hard stops within the weapon, the jerk is greater, giving a higher amplitude signal to instantaneous acceleration pulses. These temperature and mounting related variations will, in general, be of a similar magnitude to the changes in caliber and powder charge. In the present invention, these various factors can be accounted for in order to obtain sufficient signal-to-noise ratio that a determination of round strength/caliber and over- or under-pressure can be detected. As shown in FIG. 133, the Young's Modulus vs. temperature is plotted for various metals: 1 Carbon steel; 2 Nickel steel; 3. Cr—Mo Steels; 4. Copper; 5. Leaded Ni-Bronze; 6. Nickel Alloys-Monel 400; 7. Titanium; and 8. Aluminum.

Internal to many micros is the ability to measure temperature, albeit with an accuracy of only a few degrees. This may be sufficient. Alternatively, an external temperature measuring device may be used, including but not limited to, a thermistor or a thermocouple. By comparing various metrics of the x-axis accelerometer signal to those obtained during prior characterization at various temperatures, and then subtracting or otherwise factoring out the characterized signal at the present temperature, it is possible to derive a difference plot. Evaluation of this difference plot can then indicate if the most recent round shot differs from the characterized baseline, and by how much. By setting certain thresholds thereon, a determination of a variation in caliber or powder charge may be obtained.

To account for mounting changes, the shot counting unit may employ other motion signals, such as the roll angular rate. Rifling of the barrel imparts spin to the bullet, and through conservation of momentum, a spin in the reverse direction is imparted to the weapon. If the weapon were in free-fall, the momentary angular rate, imparted while the bullet was traversing the barrel, would cause the weapon to begin twisting, and by Newton's first law, it would continue to twist until slowed by friction, or acted upon by another body. If a user were holding the weapon loosely, it might be expected to twist to some extent, or to some degree, before being slowed by contact with their clothing and body. A tripod-mounted weapon would twist less, and a vehicle pintle-mounted weapon would twist the least of these three cases. Therefore, by monitoring the magnitude and cumulative sum of angular rate it is possible to determine, with some degree of certainty, how firmly mounted the weapon is. By combining the mounting firmness indication with the adjustment for temperature, it is a tenet of the present invention that the factors of mounting and temperature can be subtracted from the x-axis acceleration profile of the weapon upon recoil, to derive a difference plot from which can be measured deviations owing primarily to the round caliber and powder charge.

As a specific example, refer to FIG. 14. first, the present temperature of the weapon is measured (201). Note this can be an internal measurement, or in an alternative embodiment, the temperature could be sensed at some other location within the weapon such that the temperature sensing device is in electrical communication with the shot counter unit. As a non-limiting illustrative example, the temperature may be partitioned into one of three contiguous bins, namely: cold; neutral; hot. The shot profile can then be recorded (202). Next, the amount of twist induced in the weapon is measured (203), and partitioned among progressive thresholds in increasing order of magnitude, namely: low, meaning pintle-mounted; medium, meaning tripod mounted; and high, meaning hand-carried. When a shot is fired, and it is further desired to detect the caliber or powder charge, the following algorithm function can be executed, during, for example, the suppression time provided by timer 3 from FIG. 12 above. In this example, there are nine (9) pre-characterized x-axis acceleration profiles stored within memory (204). The micro extracts that profile corresponding to the present combination of temperature and twist. Next, the x-axis acceleration profile of the most recent shot is subtracted from the pre-characterized profile to obtain a difference plot (205). This subtraction may be carried out point-by-point, or there may be specific points within the profile which are subtracted, or the profiles may be convoluted, or the profiles may be transformed into frequency domain and then subtracted, or other methods of obtaining a difference known to those skilled in the signal processing arts. Individual points on the difference chart, or specific points, such as extrema (maxima and minima), or points at specific times, may be compared to pre-established thresholds (206), or more sophisticated means of evaluating the magnitude of deviation from the pre-characterized profiles. If, for example, the powder charge of the most recent shot is low by a statistically significant, the method of FIG. 14 will record a difference signal more negative than a threshold (207), and make the determination that this was an under-pressure event 207. A higher threshold value 208 means over pressure 209. A threshold that is neither high 208 or low 206 means that this is a normal shot 210 which is recorded for shot strength 211.

e. Barrel Length Detection

Two sensors are sensitive to, and can provide information about, the time during which the bullet travels down the barrel. The x-axis accelerometer recoil ends when the bullet leaves the barrel, and travels a sufficient distance that gas pressure communication with the barrel becomes negligible. The roll angular rate sensor twist ends when the bullet is no longer being rifled by the barrel. By knowing the round strength and powder charge, as described in the preceding section, the velocity of the bullet can be determined from previously completed and memory-stored characterization. From either the accelerometer or the angular rate sensor, the duration between the ignition of the primer in the round to the time when the bullet leaves the barrel can be detected by an algorithm within the micro. This might be, for example, a combination of two measures, one being the start and stop times of an angular twist detected by the rate sensor, and the second being the time between the detection of a high slew rate event (described above) and the time when the recoil is substantially over, as indicated for example, by a sufficiently small time-windowed cumulative acceleration sum (also described above). If both indicators agree within a reasonable margin, they may be taken to indicate the duration (D) of the bullet flight down the barrel. By knowing the velocity (V) from pre-defined memory, as indicated by the caliber and powder charge of the most recently-fired round, a simple calculation gives the length of the barrel, per Equation (1).

$$L=V*D \tag{1}$$

6. Self-Calibration

As described above, a general-purpose shot detection algorithm must be calibrated to a specific weapon design. The metals used, the dimensions involved, the mass and moments of inertia of the weapon all affect the recoil, and hence the response of the various sensors. The traditional method of calibration is to test-fire a new weapon platform under a variety of conditions that might be experienced during use. The adjustable parameters of the algorithm are then adjusted to optimize performance by, for example, increasing shot detection accuracy. This is an expensive and time-consuming method. The present disclosure provides for a means by which a weapon can be self-calibrating. This has the added benefit of providing for calibration to a specific individual weapon, which the user may have modified.

As shown in the flow chart of FIG. 15, the present conception of the shot counter unit 5 is that it can detect shots when calibrated. An uncalibrated unit, having default parameter settings, may have less than desired performance. It is therefore desirable to provide a means by which these default parameters can be adjusted in the field based on test firing of that particular weapon. Implicit in self-calibration is the existence of an active two-way communication between a remote device such as a PC and the shot counter unit. Within the PC is a software routine, which guides the self-calibration process. One non-limiting illustrative example to teach the essence of the method proceeds along the following steps. First, the shot counter unit 5 is configured to send complete engineering data profiles step 230 of FIG. 15, as has been described above. Second, the user is instructed to make a specific shot, such as a hand-held horizontal discharge using a specified round of ammunition step 231. Alternately, the user may input which type of ammunition is used. Third, a program on the PC analyzes the shot profile step 232, including the temperature, and optionally the method of mounting, and determines the most suitable set of calibration parameters from a pre-loaded set. The set of parameters selected is that which provides the greatest margin between the metrics of the shot detection algorithm and the thresholds established. Optional additional steps will repeat the second and third steps above, preferably with different variations, such as a different mounting method, a different type of ammunition, or a different temperature. Yet further additional steps may include non-shot events, such as blank firing, butt strikes, and other abuse events for the purpose of determining an error margin for non-detection of a shot step 233. In the case where multiple shots are gathered for the calibration process, the said program on the PC may use an optimization routine to select the best choice from among many. These optimization routines may include a least-squares-fit, a Hamming distance calculation, fuzzy logic, Dempster-Shafer data fusion, or other method known to those skilled in the art of engineering optimization step 234. Yet a further option for determining the best calibration might be to use evolutionary optimization, such as a genetic algorithm search routine, particle swarm optimization, or simulated annealing routine to independently search for the optimum set of parameters to maximize the margins as mentioned above step 235. A reference for this method of calibration is found in the following reference (Schubert, Peter J. "Robust Automated Airbag Module Calibration," SAE World Congress, Detroit, Mich., 2001). The fourth step is for said program on the PC to download the calibration parameters to the shot counter unit memory for use in the firmware step 236, as show in FIG. 15.

In another embodiment of the present disclosure, the shot counter 5 provides a remote and distant annunciation of the occurrence and location of a shot having been fired. Peace officers in the field fire their weapons relatively infrequently, but the consequences of each shot fired can be significant. It may therefore be desired, either by the peace officer, or by the administration of the police, sheriff, or trooper department for there to be a notification whenever the officer fires a weapon. This information may be helpful to rapidly dispatch assistance to the location of the weapon discharge. In addition, this information may aid in later investigations as to the proper conduct of events by providing accurate time and location information. Together with uploaded data from the shot counter unit including the time, cadence, and number of shots fired, together such a system can greatly reduce the uncertainty regarding the sequence of events and decisions made by the peace officer. To accomplish this, the shot counter 5 transmits either by a one-way or two-way wireless communications mode or link, as described in detail above, but need only transmit the simplest of information, namely that a shot was fired. Such a brief transmission signal requires a minimal bandwidth, a minimal message, possibly even as simple as a simple digital pulse on a specified frequency, but generally of sufficient security to prevent a false alarm, delivered to a nearby device capable of delivering the information to a central command. This can be accomplished, as one non-limiting example, by establishing a link between the shot counter unit and a cell phone or PDA carried by the officer. When the PDA receives indication of a shot having been fired, it is configured to automatically send a phone message, text message, e-mail, or other means of electronic communication known to those skilled in these arts, indicating time and position. Position may be obtained by the PDA through the global positioning satellite (GPS) system, or through location determined by the cell in which the PDA resides, or through dead reckoning through inertia sensors within the PDA, or other means of identifying location of electronic devices, such as are known to those skilled in these arts. As illustrative example, a police officer experience a surprise attack and who instantly offers return fire may have insufficient time to call for back-up. The shot counter unit on his or her weapon sends a message to an iPad in the squad car through an established Bluetooth connection. The iPad sends an e-mail through a 4G wireless communication link into which is inserted the present time and date, plus the global coordinates of the iPad, to Central Dispatch. The officer can be sent assistance in this manner, and for this example, faster, and with fewer distractions to the officer, than with other existing methods of calling for help.

While presently preferred embodiments have been described for purposes of the disclosure, numerous changes in the arrangement of method steps and those skilled in the art can make apparatus parts. Such changes are encompassed within the spirit of the invention as defined by the appended claims.

What is claimed:

1. A shot counter for recording and transmitting shot profile data of shots fired from a firearm, comprising:

A microcontroller operated module affixed to a firearm; said module comprising a MEMS accelerometer and at least one normally closed G switch for mechanically detecting the firing of each round from the weapon;

said mechanically activated, normally closed G switch upon detection of firing from said weapon activating a power circuit to said microcontroller module, which was previously unpowered, thereby extending a battery life of said shot counter, a non volatile memory for storing the shot profile data that includes shot count and recoil data, a serial communication device for transmitting said stored shot profile data to a remote location via an RF signal;

and a mechanically activated, power conservation wake up circuit wherein said normally closed mechanically activated G switch reacts faster than said MEMS accelerometer would activate itself thereby avoiding missing a capture of a first series of impulses generated by a shot being fired due to a delay of the MEMS accelerometer activating itself, in order for said normally closed mechanically activated G switch to permit the capture by said microcontroller of MEMS supplied information to determine if a shot was fired, if it was a single shot or multiple shots such as when fired in automatic mode, and determining from energy generated if the shot was a live round or a blank and any under pressure/overpressure in the round.

2. The counter according to claim 1, wherein said wake up circuit is a normally closed g switch.

3. The shot counter according to claim 1 further comprising:

a temperature sensing device for measuring device for measuring the present temperature of said firearm wherein the temperature sensing device is in electrical communication with the shot counter; a device for measuring an amount of twist induced in the firearm, and partitioned among progressive thresholds in increasing the order of magnitude, namely: low, meaning pintle-mounted; medium, meaning tripod mounted; and high, meaning hand-carried.

4. The shot counter according to claim 3 wherein the temperature is partitioned into one of three contiguous bins: cold; neutral; and hot.

5. The shot counter according to claim 3 wherein said device for measuring an amount of twist induced in the firearm, and partitioned among progressive thresholds is in increasing order of magnitude, namely: low, meaning pintle-mounted; medium, meaning tripod mounted; and high, meaning hand-carried.

6. The shot counter according to claim 1 wherein said shot counter transmits a message to a supply depot providing a total number of rounds fired by said firearm and requests additional ammunition.

7. The shot counter according to claim 1 wherein said shot counter stores a maintenance log in memory for said firearm.

8. The shot counter according to claim 1 wherein said shot counter records time and date of each round being fired by said firearm.

9. The shot counter according to claim 8 wherein said recordal of time and date of each round being fired provides for documentation for use by law enforcement officers to recreate an incident when an officer discharges his or her firearm.

10. The shot counter according to claim 1 wherein said shot counter records the time and date of each round fired by said firearm and differentiates between actual rounds fired and blanks.

11. A shot counter according to claim 1 wherein said memory is partitioned to permit for additional storage, transmits data utilizing various communications protocol.

12. A shot counter according to claim 1 wherein said shot counter transmits data utilizing various communications protocol.

13. A shot counter according to claim 1 wherein said shot counter has a two way communications link that includes error checking of data through said communications.

14. The shot counter according to claim 13 wherein said communications link is wireless.

15. The shot counter according to claim 13 wherein said communications link is wired.

16. A shot counter according to claim 1 wherein said shot counter transmits an audible or visual alert to a user of unsafe conditions.

17. A shot counter according to claim 1 wherein said shot counter includes a detection device for detecting jamming of said firearm and alerts a user that said firearm is unsafe to use.

18. A shot counter according to claim 1 wherein said shot counter is capable of configuration control and stores information on interchangeable parts.

19. A shot counter according to claim 1 wherein said shot counter processes the data to derive certain higher level metrics and stores said higher level metrics in said memory, said higher level metrics includes data as to whether shot was fired; if a round was a blank or a bullet; a maximum amplitude of a shot signal; accumulative sum of the shot signal; duration of a bullet traversing the barrel of said firearm; and/or an indication of a strength of a round.

20. A shot counter according to claim 1 wherein said shot counter detects a round being fired from the firearm and notifies a central command that one or more shots have been fired.

21. A shot counter according to claim 20 wherein said shot counter has a communications link to transmit data to said central command that a shot was fired.

22. A shot counter according to claim 21 wherein said communications link is a one way wireless link.

23. A shot counter according to claim 21 wherein said communications link is a two way wireless link.

24. A shot counter according to claim 21 wherein said communications link has a minimal bandwidth, a minimal message, but of sufficient security to prevent a false alarm, delivered to a nearby device capable of delivering the information to said central command.

25. A shot counter according to claim 19 wherein said data from the shot counter unit includes time, cadence, and number of shots fired.

26. A shot counter according to claim 24 wherein said nearby device is a phone or PDA.

27. A shot counter according to claim 26 wherein said cell phone or PDA, is adapted to be carried by an officer, establishing a link between the shot counter unit and the cell phone or the PDA so that when the PDA receives indication of a shot having been fired, it automatically sends either a phone message, text message, e-mail, or other known electronic communications transmissions indicating time and position where the shot was fired to provide assistance at a location where said shot was fired for the officer.

28. A shot counter according to claim 27 wherein position is obtained by the PDA through either global positioning satellite (GPS) system, or through location determined by the cell phone in which the PDA resides, or through dead reckoning through inertia sensors within the PDA, or other known electronic devices for identifying location.

29. A shot counter according to claim 28 wherein the shot counter unit on the firearm of an officer sends a message to an iPad in a squad car through an established Bluetooth connection and the iPad sends an e-mail through a 4G wireless communication link into which is inserted a present time and date, plus the global coordinates of the iPad, to Central Command so that the officer can be sent assistance without needing to request back up.

30. The shot counter according to claim 1 wherein said remote device is a PC.

31. A shot counter according to claim 18 wherein said interchangeable parts includes a barrel.

32. A shot counter according to claim 24 wherein said minimal message is a simple digital pulse on a specified frequency.

33. The shot counter according to claim 1 wherein said shot counter gathers shot data including full shot acceleration profile data along the weapons barrel axis; angular rate about the barrel axis during a shot; duration of the shot related to barrel length and strength of the round, wherein the x-axis acceleration profile of the most recent shot is subtracted from the pre-characterized profile to obtain a difference plot and compared to pre-established thresholds, or more sophisticated techniques or means of evaluating the magnitude of deviation from the pre-characterized profile to determine if this an under pressure event, an over pressure event or a normal shot and if a normal shot it is recorded for shot strength and a velocity (V) from the memory, as indicated by a caliber and a powder charge of a most recently- fired round, a length of a barrel of said firearm is determined as: $L=V*D$ and said shot counter is self calibrating through an active two-way communication between a remote device and said shot counter unit.

* * * * *